US010501702B2

(12) United States Patent
Sampler et al.

(10) Patent No.: US 10,501,702 B2
(45) Date of Patent: Dec. 10, 2019

(54) LUBRICATING COMPOSITIONS COMPRISING AN ANTI-WEAR/FRICTION MODIFYING AGENT

(71) Applicant: The Lubrizol Corporation, Wickliffe, OH (US)

(72) Inventors: Edward P. Sampler, Leicestershire (GB); Mark J. McGuiness, Chagrin Falls, OH (US); William R. S. Barton, Belper (GB); Deborah Kays, Nottingham (GB); Nicolas I. Nouvel, Ashby-de-la-Zouch (GB); Gary M. Walker, Allestree (GB); Katherine M. Shaw, Beeston (GB)

(73) Assignee: The Lubrizol Corporation, Wickliffe, OH (US)

( * ) Notice: Subject to any disclaimer, the term of this patent is extended or adjusted under 35 U.S.C. 154(b) by 118 days.

(21) Appl. No.: 15/556,927

(22) PCT Filed: Mar. 2, 2016

(86) PCT No.: PCT/US2016/020416
§ 371 (c)(1),
(2) Date: Sep. 8, 2017

(87) PCT Pub. No.: WO2016/144639
PCT Pub. Date: Sep. 15, 2016

(65) Prior Publication Data

US 2018/0066204 A1 Mar. 8, 2018

Related U.S. Application Data

(60) Provisional application No. 62/130,952, filed on Mar. 10, 2015.

(51) Int. Cl.
*C10M 139/00* (2006.01)
*C10M 159/18* (2006.01)

(52) U.S. Cl.
CPC ..... *C10M 139/00* (2013.01); *C10M 159/18* (2013.01); *C10M 2201/085* (2013.01); *C10M 2201/087* (2013.01); *C10M 2203/1025* (2013.01); *C10M 2205/0285* (2013.01); *C10M 2207/022* (2013.01); *C10M 2207/023* (2013.01); *C10M 2207/026* (2013.01); *C10M 2207/028* (2013.01); *C10M 2215/02* (2013.01); *C10M 2215/026* (2013.01); *C10M 2215/04* (2013.01); *C10M 2215/064* (2013.01); *C10M 2215/08* (2013.01); *C10M 2215/223* (2013.01); *C10M 2215/28* (2013.01); *C10M 2219/022* (2013.01); *C10M 2219/046* (2013.01); *C10M 2219/082* (2013.01); *C10M 2223/043* (2013.01); *C10M 2223/045* (2013.01); *C10M 2227/061* (2013.01); *C10M 2227/062* (2013.01); *C10N 2210/02* (2013.01); *C10N 2210/05* (2013.01); *C10N 2230/06* (2013.01); *C10N 2230/42* (2013.01); *C10N 2240/04* (2013.01); *C10N 2240/10* (2013.01); *C10N 2260/12* (2013.01); *C10N 2260/14* (2013.01)

(58) Field of Classification Search
CPC ..... C10M 139/00; C10M 159/18; C10M 2227/061; C10M 2201/085; C10M 2201/087; C10M 2207/022; C10M 2207/023; C10M 2207/026; C10M 2207/028; C10M 2215/02; C10M 2215/026; C10M 2215/04; C10M 2215/064; C10M 2215/08; C10M 2215/223; C10M 2215/28; C10M 2219/022; C10M 2219/046; C10M 2219/082; C10M 2223/043; C10M 2223/045; C10M 2227/062; C10N 2210/02; C10N 2210/05; C10N 2230/06; C10N 2230/42; C10N 2240/04; C10N 2240/10; C10N 2260/12; C10N 2260/14
See application file for complete search history.

(56) References Cited

U.S. PATENT DOCUMENTS 2,795,548 A * 6/1957 Thomas ..... C07F 5/04 252/389.41
4,557,844 A 12/1985 Horodysky
4,629,576 A * 12/1986 Small, Jr. ..... C10M 141/12 508/199
4,781,850 A 11/1988 Doner et al.
5,629,272 A 5/1997 Nakazato et al.
(Continued)

FOREIGN PATENT DOCUMENTS

EP 0206748 A2 12/1986
EP 0673991 A1 9/1995
GB 2103651 A 2/1983

OTHER PUBLICATIONS

European Patent Office, International Search Report for PCT/US16/020416, dated Aug. 17, 2016.
(Continued)

*Primary Examiner* — James C Goloboy
(74) *Attorney, Agent, or Firm* — Christopher P. Demas; Teresan W. Gilbert

(57) ABSTRACT

A phosphate complex of a borate ester provides wear- and friction-reducing performance to an engine or driveline device. The complex may be a pyroborate-hydrocarbyl-substituted phosphate adduct. Boric acid may be reacted with a diol to form an ester, then reacting said ester with an ammonium salt of phosphoric acid or a hydrocarbyl-substituted phosphoric acid.

18 Claims, No Drawings

(56) References Cited

U.S. PATENT DOCUMENTS

| | | | | |
|---|---|---|---|---|
| 6,656,887 | B2 * | 12/2003 | Yagishita | C10M 137/02<br>508/371 |
| 2006/0025313 | A1 * | 2/2006 | Boffa | C10M 163/00<br>508/199 |

OTHER PUBLICATIONS

European Patent Office, Written Opinion for PCT/US16/020416, dated Aug. 17, 2016.

* cited by examiner

LUBRICATING COMPOSITIONS COMPRISING AN ANTI-WEAR/FRICTION MODIFYING AGENT

BACKGROUND OF THE INVENTION

The disclosed technology relates to lubricant compositions and concentrates comprising novel wear and/or friction reducing agents and to the use of same. The wear-reducing/friction-reducing agents are compounds containing a phosphate complex of a borate ester.

It is important to protect a mechanical device, such as an engine or a driveline device, against wear during operation in order to maintain performance and extend the lifetime of the device. It is desirable to effect lubrication of a mechanical device so as to minimize friction between surfaces, thus reducing energy losses. Phosphorus-containing compounds are used as anti-wear additives in lubricating compositions for engines and driveline devices. In particular, zinc dialkyl dithiophosphates (ZDDP) are known for use in engine oils as anti-wear additives. However, as industry standards require increasingly lower limits of phosphorus in such lubricating oil compositions, there is a need to provide a reduction in the amount of phosphorus-containing additives used without compromising the required anti-wear properties. There is a need to provide alternative anti-wear additives which contribute lower phosphorus levels to a lubricating composition and yet impart excellent wear resistance properties to the lubricating composition. There is a need for new, effective anti-wear additives for lubricating compositions. There is also a need for new, effective friction reducing additives for lubricating compositions. Further, there is a need for new additives that can function effectively as both anti-wear and friction-reducing additives.

SUMMARY OF THE INVENTION

The disclosed technology provides a composition comprising an oil of lubricating viscosity and a compound of formula (I):

(I)

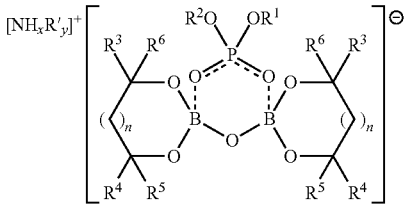

wherein x+y=4, x is an integer from 1 to 4, y is 0 or an integer from 1 to 3, and each R' is independently a hydrocarbyl group having from about 4 to about 22 carbon atoms;

$R^1$ and $R^2$ are each independently hydrogen or a hydrocarbyl group containing from about 4 to about 22 carbon atoms, and on each ring substituted with $R^3$ to $R^6$ independently, (i) n is 0 or 1, one of $R^3$ and $R^4$ is —$CH_2$—O—C(O)—$R^7$ where $R^7$ is a hydrocarbyl group containing from about 8 to about 30 carbon atoms, and the other of $R^3$ and $R^4$, and each of $R^5$ and $R^6$ is chosen from hydrogen or a methyl group; or (ii) n is 0 or 1, one of $R^3$ and $R^4$ is a hydrocarbyl group containing from about 4 to about 22 carbon atoms and the other of $R^3$ and $R^4$ is independently a hydrocarbyl group containing from about 4 to about 22 carbon atoms or hydrogen, and each of $R^5$ and $R^6$ is hydrogen; or (iii) n is 0, $R^3$ and $R^4$ are linked, together with the carbons to which they are attached, to form a benzene ring which is substituted with a hydrocarbyl group $R^1$ containing from about 12 to about 100 carbon atoms, and $R^5$ and $R^6$ are not present.

Formula (I) may also be drawn more generally as follows,

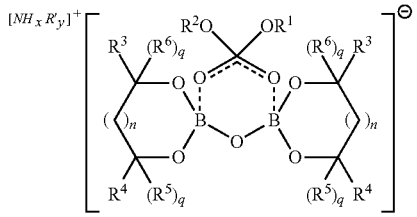

where the variables are as defined above and q is 0 or 1 in order to satisfy the valence of the carbon atom to which $R^5$ and $R^6$ are optionally attached.

Option iii of formula (I) may also be written as follows:

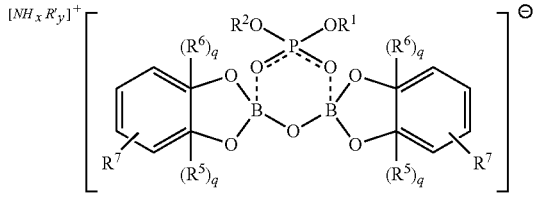

where q=0, that is, $R^5$ and $R^6$ are not present (but in options (i) or (ii), q is 1).

It has been found that the compound of formula (I) can impart excellent anti-wear properties and/or friction reducing properties to an oil of lubricating viscosity. The composition of the invention is particularly useful as or in lubricating compositions (lubricants) for mechanical devices such as engines or driveline devices. Advantageously, a reduction in wear in the operation of a mechanical device will result in the smoother operation of the device and will help extend the lifetime of the device and its component parts. Further, advantageously, a reduction in friction will help reduce energy losses in the operation of said device.

The disclosed technology further provides a method of preparing the above-mentioned composition which comprises mixing an oil of lubricating viscosity with a compound of formula (I). Further additives may be added to the composition thus tailoring it to a specific end use, for example, as a particular functional fluid such as an engine oil, gear oil or automatic transmission fluid.

The disclosed technology provides a method of improving the anti-wear properties and/or friction reducing properties of an oil of lubricating viscosity by adding a compound of formula (I) to an oil of lubricating viscosity and a method of lubricating a mechanical device comprising supplying thereto the composition referred to above.

The disclosed technology also provides for the use of a compound of formula (I) as an anti-wear additive (agent) and/or a friction-reducing additive (agent) in a composition comprising an oil of lubricating viscosity.

DETAILED DESCRIPTION OF THE INVENTION

Various preferred features and embodiments will be described below by way of non-limiting illustration.

The disclosed technology provides a composition comprising an oil of lubricating viscosity and a compound of formula (I)

(I)

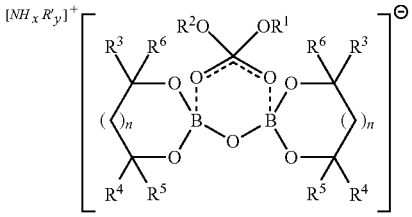

wherein x+y=4, x is an integer from 1 to 4, y is 0 or an integer from 1 to 3, and each R' is independently a hydrocarbyl group having from about 4 to about 22 carbon atoms, about 4 to about 18 or about 4 to about 14 carbon atoms;

$R^1$ and $R^2$ are each independently hydrogen or a hydrocarbyl group containing from about 4 to about 22 carbon atoms, about 4 to about 8, or about 6 to about 8 carbon atoms, and, on each ring substituted with $R^3$ to $R^6$ independently, (i) n is 0 or 1, one of $R^3$ and $R^4$ is —$CH_2$—O—C(O)—$R^7$ where $R^7$ is a hydrocarbyl group containing from about 8 to about 30 carbon atoms, about 8 to about 18 or about 16 to about 18 carbon atoms, and the other of $R^3$ and $R^4$, and each of $R^5$ and $R^6$ is chosen from hydrogen or a methyl group; or (ii) n is 0 or 1, one of $R^3$ and $R^4$ is a hydrocarbyl group containing from about 4 to about 22 carbon atoms or about 4 to about 10 carbon atoms and the other of $R^3$ and $R^4$ is independently a hydrocarbyl group containing from about 4 to about 22 carbon atoms or about 4 to about 10 carbon atoms or hydrogen, and each of $R^5$ and $R^6$ is hydrogen; or (iii) n is 0, $R^3$ and $R^4$ are linked, together with the carbons to which they are attached, to form a benzene ring which is substituted with a hydrocarbyl group $R^1$ containing from about 12 to about 100 carbon atoms, about 12 to about 24, about 24 or 35 to about 48, about 48 or 70 to about 100 carbon atoms, and $R^5$ and $R^6$ are not present, as described above.

The compound of formula (I) is oil-soluble.

The compound of formula (I) contains a cation $[NH_xR'_y]^+$, wherein x+y=4, x is an integer form 1 to 4, y is 0 or an integer from 1 to 3, and each R' is independently a hydrocarbyl group, includes an ammonium ion and a hydrocarbyl-substituted ammonium ion, for example, a quaternary ammonium ion.

R' is a hydrocarbyl group which contains from about 4 to about 22, about 4 to about 18 or about 4 to about 14 or about 8 carbon atoms. R' can be an aliphatic hydrocarbyl group, such as an alkyl group. R' can be branched or linear. When one or more R' groups are present, they can be the same or different.

In one embodiment, the cation $[NH_xR'_y]^+$ contains at least one R' group, i.e. y=1, 2 or 3. The at least one R' group can contain form about 4 to about 22 carbon atoms and can be an aliphatic hydrocarbyl group. The at least one R' group can be, for example, an aliphatic hydrocarbyl group having from 6 to 12 carbon atoms, for example a $C_{6-12}$-alkyl or a $C_8$-alkyl group. In one embodiment, the at least one R' group is an aliphatic hydrocarbyl group containing enough carbon atoms to help impart oil solubility to the compound of formula (I).

In one embodiment, x=y=2. The R' group can be an aliphatic group, for example a $C_4$ to a $C_{22}$ or a $C_{18}$ or a $C_{14}$-alkyl group. The alkyl group can be branched or linear. The branching can be such that at least one of the alkyl branches has at least 6 carbon atoms. This is the case for a 2-ethylhexyl group which comprises one alkyl chain (branch) comprising 6 carbon atoms and one branch comprising 2 carbon atoms. In one embodiment, R' is a branched alkyl group, for example, a branched $C_8$-alkyl group such as a 2-ethylhexyl group. Both R' groups can be the same and can each be a 2-ethylhexyl group, for example.

In another embodiment x=1, y=3 and each R' is independently a hydrocarbyl group containing 4 to 8 carbon atoms, for example a $C_4$ to $C_8$-alkyl group. The three R' groups can be the same or different. In one embodiment, x=1, y=3 and each R' is a C8-alkyl group, for example a 2-ethylhexyl group.

In the compound of formula (I), the cation is paired with a complex anion of formula (iia):

(iia)

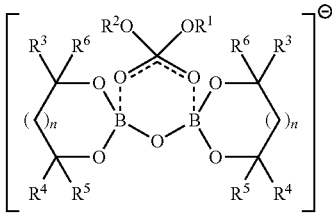

where the $R^1$, $R^2$, $R^3$, $R^4$, $R^5$ and $R^6$ groups are as defined for formula (I) above.

The anion can be a dihydrogen phosphate complex of a borate ester (when $R^1$ and $R^2$ are each hydrogen) and can be a hydrocarbyl-substituted phosphate complex of a borate ester (when at least one of $R^1$ and $R^2$ is a hydrocarbyl group). The borate ester is a pyroborate and the complex anion can be described as a pyroborate-dihydrogen phosphate adduct or a pyroborate-hydrocarbyl-substituted phosphate adduct in which the pyroborate acts as a chelating bifunctional Lewis acid in the complementary binding of the bidentate Lewis base dihydrogen phosphate or the bidentate Lewis base hydrocarbyl-substituted phosphate.

Borate esters (pyroborates) useful in forming the complex anions of the invention can be obtained by reacting an appropriate diol with boric acid ($B(OH)_3$). The reaction is such that all (100%) of the hydroxyl groups on the diol are borated. The compound of formula (I) can then be obtained by reacting the borate ester with the appropriate ammonium phosphate compound, for example $[NH_xR'_y]^+[R^1R^2PO_4]^-$, by means known in the art.

In one embodiment, each of $R^1$ and $R^2$ is hydrogen and the compound of formula (I) can be obtained by reacting an appropriate borate ester with $[NH_xR'_y]^+[H_2PO_4]^-$. In another embodiment, at least one of $R^1$ and $R^2$ is a hydrocarbyl group containing from about 4 to about 22, about 4 to about 8, or about 6 to about 8 carbon atoms. In another embodiment, one of $R^1$ and $R^2$ is a hydrocarbyl group containing from about 4 to about 22, about 4 to about 8, or about 6 to about 8 carbon atoms, and the other of $R^1$ and $R^2$ is hydrogen. The hydrocarbyl group can be an aliphatic hydrocarbyl group, such as an alkyl group, and can be branched or linear.

In one embodiment of formula (I) or (iia), on each ring substituted with $R^3$ to $R^6$ independently, n is 0 or 1 and the $R^3$ to $R^6$ groups are defined as in option (i) or (ii) as detailed above, i.e., (i) one of $R^3$ and $R^4$ is —$CH_2$—O—C(O)—$R^7$ where $R^7$ is a hydrocarbyl group containing from about 8 to about 30 carbon atoms, about 8 to about 18 or about 16 to about 18 carbon atoms, and the other of $R^3$ and $R^4$, and each of $R^5$ and $R^6$ is chosen from hydrogen or a methyl group; or (ii) one of $R^3$ and $R^4$ is a hydrocarbyl group containing from about 4 to about 22 carbon atoms or about 4 to about 10 carbon atoms and the other of $R^3$ and $R^4$ is independently a hydrocarbyl group containing from about 4 to about 22 carbon atoms or about 4 to about 10 carbon atoms or hydrogen, and each of $R^5$ and $R^6$ is hydrogen.

In one embodiment, at least one or both of the rings substituted with $R^3$ to $R^6$ independently, the $R^3$ to $R^6$ groups are defined as in option (i), and one of $R^5$ and $R^6$ is hydrogen and the other of $R^5$ and $R^6$ is a methyl group. In one embodiment, at least one or both of the rings substituted with $R^3$ to $R^6$ independently, the $R^3$ to $R^6$ groups are defined as in option (i), and $R^3$ is —$CH_2$—O—C(O)—$R^7$, $R^6$ is a methyl group and $R^5$ is hydrogen or when $R^4$ is —$CH_2$—O—C(O)—$R^7$, $R^5$ is a methyl group and $R^6$ is hydrogen.

A borate ester useful in forming the compound of formula (I) in the embodiment of option (i) above can be obtained by reacting boric acid with a partial ester diol having the formula $(R^3)(OH)CR^6$—$(CH_2)_n$—$CR^5(R^4)(OH)$ where one of $R^3$ and $R^4$ is —$CH_2$—O—C(O)—$R^7$ as defined above and the other of $R^3$ and $R^4$ and each of $R^5$ and $R^6$ is hydrogen or a methyl group. For example, the partial ester diol can be a glycerol monoester having the formula (OH)$CH_2$—CH(OH)($CH_2$—O—C(O)—$R^5$) obtained by reacting glycerol with a carboxylic acid containing a $R^7$ hydrocarbyl group having from about 8 to about 30 carbon atoms. For example, the partial ester diol can be a methylated glycerol monoester having the formula (OH)$CH_2$—$C(CH_3)$(OH)($CH_2$—O—C(O)—$R^7$) wherein $R^7$ is hydrocarbyl group having from about 8 to about 30 carbon atoms. In this embodiment, n is 0, $R^3$ and $R^6$ are each hydrogen, $R^5$ is a methyl group and $R^4$ is —$CH_2$—O—C(O)—$R^7$. An example of this partial ester diol is methylated glycerol monooleate, i.e. when $R^7$ is $C_{17}H_{33}$.

A borate ester useful in forming the compound of formula (I) in the embodiment of option (ii) above can be obtained by reacting boric acid with a hydrocarbyl-substituted diol having the formula $(R^3)(OH)CH$—$(CH_2)_n$—$CH(R^4)(OH)$ where one of $R^3$ and $R^4$ is a hydrocarbyl group containing from about 4 to about 22 or about 4 to about 10 carbon atoms and the other of $R^3$ and $R^4$ is independently a hydrocarbyl group containing from about 4 to about 22 or about 4 to about 10 carbon atoms or hydrogen. In one exemplary embodiment of option (ii) above, when each of $R^3$ and $R^4$ is independently a hydrocarbyl group containing from about 4 to about 22 carbon atoms, the sum of the carbon atoms in the $R^3$ and the $R^4$ groups on said ring is 22 or less. In one exemplary embodiment of option (ii), at least one of $R^1$, $R^2$, $R^3$ or $R^4$ is a hydrocarbyl group containing at least 8 carbon atoms.

In one embodiment, n=0 and the complex anion has the following formula (iib)

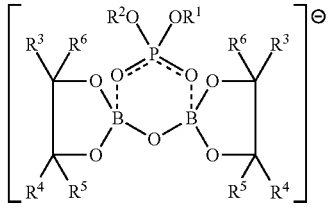

In one embodiment of formula (I) or (iib), on each ring substituted with $R^3$ to $R^6$ independently, n is 0 and the $R^3$, $R^4$, $R^5$ and $R^6$ groups are defined as in option (i), (ii) or (iii) as detailed above, i.e., (i) one of $R^3$ and $R^4$ is —$CH_2$—O—C(O)—$R^7$ where IC is a hydrocarbyl group containing from about 8 to about 30, about 8 to about 18 or about 16 to about 18 carbon atoms, and the other of $R^3$ and $R^4$, and each of $R^5$ and $R^6$ is chosen from hydrogen or a methyl group, or (ii) one of $R^3$ and $R^4$ is a hydrocarbyl group containing from about 4 to about 22 or about 4 to about 10 carbon atoms and the other of $R^3$ and $R^4$ is independently a hydrocarbyl group containing from about 4 to about 22 or about 4 to about 10 carbon atoms or hydrogen, and each of $R^5$ and $R^6$ is hydrogen, or (iii) $R^3$ and $R^4$ are linked, together with the carbons to which they are attached, to form a benzene ring which is substituted with a hydrocarbyl group $R^7$ containing from about 12 to about 100, about 12 to about 24, about 24 or 35 to about 48, about 48 or 70 to about 100, carbon atoms, and $R^5$ and $R^6$ are not present, as described above.

For the embodiments of options (i) and (ii), when n=0, the borate esters useful in preparing the compound of formula (I) can be obtained as described previously for the embodiments of options (i) and (ii), where the diols are vicinal diols. For the embodiment of option (iii), the borate ester can be formed by reacting boric acid with a catechol (1,2-dihydroxybenzene) substituted with a hydrocarbyl group. The hydrocarbyl group is $R^7$, containing from about 12 to about 100, about 12 to about 24, about 24 or 35 to about 48, about 48 or 70 to about 100, carbon atoms. $R^7$ can be derived from a polyolefin such as for example polyisobutene, polyethylene or polypropylene. In an exemplary embodiment $R^7$ is derived from polyisobutene (PIB). For example, IC derived from $PIB_{1000}$ is hydrocarbyl group having about 70-72 carbon atoms, e.g. a $C_{70}$-alkyl or $C_{72}$-alkyl group.

In one embodiment the compound of formula (I) is one selected from those given in Table 1. (No indication is intended regarding cis or trans orientation of the substituents about the central boron-containing structure.)

TABLE 1

| Compound A | |
|---|---|
| Cation: | $[N(2\text{-ethylhexyl})_2H_2]^+$ |
| Anion: | 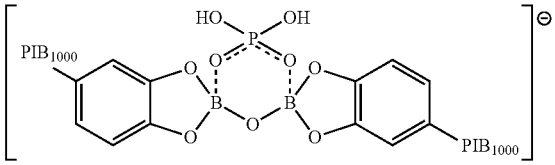 |
| **Compound B** | |
| Cation: | $[N(2\text{-ethylhexyl})_2H_2]^+$ |
| Anion: | 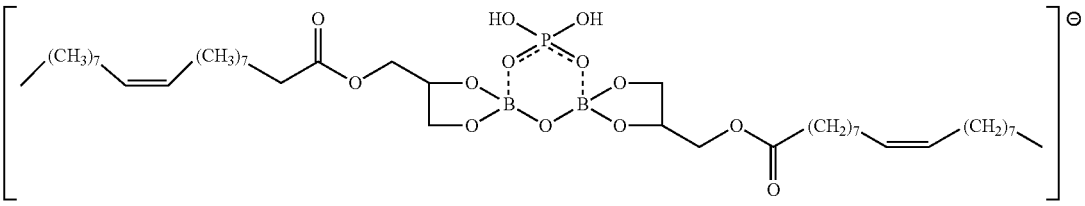 |
| **Compound C** | |
| Cation: | $[N(butyl)_3H]^+$ |
| Anion: | 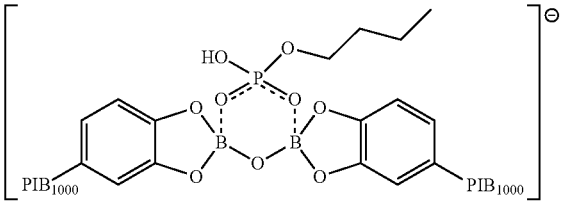 |

It has been found that the compound of formula (I) can be used to improve the anti-wear properties and/or friction reducing properties of a lubricating composition and, in particular, to impart wear-reducing properties and/or friction-reducing properties to a lubricating composition such as, for example, a driveline oil (such as a gear oil or an automatic transmission fluid) or an engine oil.

The present technology provides a composition which comprises, as one component, an oil of lubricating viscosity. Such oils include natural and synthetic oils, oil derived from hydrocracking, hydrogenation, and hydrofinishing, unrefined, refined and re-refined oils and mixtures thereof.

Unrefined oils are those obtained directly from a natural or synthetic source generally without (or with little) further purification treatment.

Refined oils are similar to the unrefined oils except they have been further treated in one or more purification steps to improve one or more properties. Purification techniques are known in the art and include solvent extraction, secondary distillation, acid or base extraction, filtration, percolation and the like.

Re-refined oils are also known as reclaimed or reprocessed oils, and are obtained by processes similar to those used to obtain refined oils and often are additionally processed by techniques directed to removal of spent additives and oil breakdown products.

Natural oils useful in making the inventive lubricants include animal oils, vegetable oils (e.g., castor oil,), mineral lubricating oils such as liquid petroleum oils and solvent-treated or acid-treated mineral lubricating oils of the paraffinic, naphthenic or mixed paraffinic-naphthenic types and oils derived from coal or shale or mixtures thereof.

Synthetic lubricating oils are useful and include hydrocarbon oils such as polymerized and interpolymerized olefins (e.g., polybutylenes, polypropylenes, propylene-isobutylene copolymers); poly(1-hexenes), poly(1-octenes), poly(1-decenes), and mixtures thereof; alkyl-benzenes (e.g. dodecylbenzenes, tetradecylbenzenes, dinonylbenzenes, di-(2-ethylhexyl)-benzenes); polyphenyls (e.g., biphenyls, terphenyls, alkylated polyphenyls); diphenyl alkanes, alkylated diphenyl alkanes, alkylated diphenyl ethers and alkylated diphenyl sulfides and the derivatives, analogs and homologs thereof or mixtures thereof.

Other synthetic lubricating oils include polyol esters (such as Priolube®3970), diesters, liquid esters of phosphorus-containing acids (e.g., tricresyl phosphate, trioctyl phosphate, and the diethyl ester of decane phosphonic acid), or polymeric tetrahydrofurans. Synthetic oils may be produced by Fischer-Tropsch reactions and typically may be hydroisomerized Fischer-Tropsch hydrocarbons or waxes. In one embodiment oils may be prepared by a Fischer-Tropsch gas-to-liquid (GTL) synthetic procedure as well as other gas-to-liquid (GTL) oils.

GTL base oils include base oils obtained by one or more possible types of GTL processes, typically a Fischer-Tropsch process. The GTL process takes natural gas, predominantly methane, and chemically converts it to synthesis gas, or syngas. Alternatively, solid coal can also be converted into synthesis gas. Synthesis gas mainly contains carbon monoxide (CO) and hydrogen ($H_2$), which are mostly subsequently chemically converted to paraffins by a catalytic Fischer-Tropsch process. These paraffins will have a range of molecular weights and by the use of catalysts can be hydroisomerised to produce a range of base oils. GTL base stocks have a highly paraffinic character, typically greater than 90% saturates. Of these paraffinics, the non-cyclic paraffinic species predominate over the cyclic paraffinic species. For example, GTL base stocks typically comprise greater than 60 wt %, or greater than 80 wt %, or greater than 90 wt % non-cyclic paraffinic species. GTL base oils typically have a kinematic viscosity at 100° C. of between 2 cSt and 50 cSt, or 3 cSt to 50 cSt, or 3.5 cSt to 30 cSt. The GTL exemplified in this instance has a kinematic viscosity at 100° C. of about 4.1 cSt. Likewise, the GTL base stocks are typically characterised as having a viscosity index (VI, refer to ASTM D2270) of 80 or greater, or 100 or greater, or 120 or greater. The GTL exemplified in this instance has a VI of 129. Typically GTL base fluids have effectively zero sulphur and nitrogen contents, generally less than 5 ppm of each of these elements. GTL base stocks are Group III oils, as classified by the American Petroleum Institute (API).

Poly-alpha olefin base oils (PAOs), and their manufacture, are generally well known. With regards PAOs, the PAO base oils may be derived from linear C2 to C32, preferably C4 to C16, alpha olefins. Particularly preferred feedstocks for PAOs are 1-octene, 1-decene, 1-dodecene and 1-tetradecene. The PAO exemplified in this instance has a kinematic viscosity at 100° C. of about 3.96 cSt and a VI of 101.

Oils of lubricating viscosity may also be defined as specified in the American Petroleum Institute (API) Base Oil Interchangeability Guidelines. The five base oil groups are as follows: Group I (sulfur content >0.03 wt %, and/or <90 wt % saturates, viscosity index 80-120); Group II (sulfur content ≤0.03 wt %, and ≥90 wt % saturates, viscosity index 80-120); Group III (sulfur content ≤0.03 wt %, and ≥90 wt % saturates, viscosity index ≥120); Group IV (all polyalphaolefins (PAOs)); and Group V (all others not included in Groups I, II, III, or IV). The oil of lubricating viscosity may also be an API Group II+ base oil, which term refers to a Group II base oil having a viscosity index greater than or equal to 110 and less than 120, as described in SAE publication "Design Practice: Passenger Car Automatic Transmissions", fourth Edition, AE-29, 2012, page 12-9, as well as in U.S. Pat. No. 8,216,448, column 1 line 57.

The oil of lubricating viscosity may be an API Group IV oil, or mixtures thereof, i.e., a polyalphaolefin. The polyalphaolefin may be prepared by metallocene catalyzed processes or from a non-metallocene process.

The oil of lubricating viscosity may comprise an API Group I, Group II, Group III, Group IV, Group V oil or mixtures thereof.

Often the oil of lubricating viscosity is an API Group I, Group II, Group II+, Group III, Group IV oil or mixtures thereof. Alternatively the oil of lubricating viscosity is often an API Group II, Group II+, Group III or Group IV oil or mixtures thereof. Alternatively the oil of lubricating viscosity is often an API Group II, Group II+, Group III oil or mixtures thereof.

The amount of the oil of lubricating viscosity present is typically the balance remaining after subtracting from 100 wt % the sum of the amount of the compound of formula (I) as described herein above and, when present, other performance additives. The composition may be in the form of a concentrate or a fully formulated lubricant. If the composition is in the form of a fully formulated lubricant, typically the oil of lubricating viscosity, including any diluent oil present in the composition, will be present in an amount of from 70 to 95 wt %, or from 80 to 85 or 93 wt %. If the lubricating composition of the invention is in the form of a concentrate (which may then be combined with additional oil to form, in whole or in part, a finished lubricant), typically the oil of lubricating viscosity, including any diluent oil present in the composition, will be present in an amount of from 0.1 to 40 wt %, 0.2 to 35 wt %, 0.4 to 30 wt %, 0.6 to 25 wt %, 0.1 to 15 wt % or 0.3 to 6 wt %.

In some embodiments, the compositions of the invention are lubricating compositions which can include a compound of formula (I) in an amount from 0.01 to 6 or 15, 0.03 to 2.0, 0.5 to 1.5 wt % of the overall composition on an oil free basis. The compositions of the invention can include a compound of formula (I) in an amount so as to contribute 300 to 600 ppm, 300 to 900 or 1200 ppm or 600 to 900 ppm or 900 to 1200 ppm phosphorus to the composition. The balance of these lubricating compositions may be one or more additional additives as described below and a major amount of oil of lubricating viscosity including any diluent oil or similar material carried into the composition from one or more of the components described herein. By major amount is meant greater than 50 wt % based on the composition.

In some embodiments, the compositions of the invention are concentrates, which can also be referred to as additive concentrates or additive compositions, which can include a compound of formula (I) in an amount from 2 to 30 wt %, 4 to 25 wt % or 7.5 to 22 wt % of the overall composition on an oil free basis. The balance of these compositions may be one or more additional additives as described below, and a minor amount of lubricating oil including any diluent oil or similar material carried into the composition from one or more of the components described herein. By minor amount is meant 50 wt % or less than 50 wt % based on the composition.

The invention provides for the use of such additive concentrates as anti-wear additives in a lubricating composition.

Other components may be present in amounts which are suitable to the end use to which the lubricant is to be employed. Lubricants (or functional fluids) for driveline devices such as automatic transmissions will typically have their own spectrum of additives; similarly lubricants (or functional fluids) for engine oils (passenger car, or heavy duty diesel, or marine diesel, or small two-cycle) will each have their characteristic additives, which are well known to those skilled in the art of lubricating such devices. In general, lubricant formulations can optionally include any of the following additives:

Dispersants

Dispersants are well known in the field of lubricants and include primarily what are sometimes referred to as "ashless" dispersants because (prior to mixing in a lubricating composition) they do not contain ash-forming metals and they do not normally contribute any ash forming metals when added to a lubricant. Dispersants are characterized by a polar group attached to a relatively high molecular weight hydrocarbon chain.

One class of dispersant is Mannich bases. These are materials which are formed by the condensation of a higher molecular weight, alkyl substituted phenol, an alkylene polyamine, and an aldehyde such as formaldehyde and are described in more detail in U.S. Pat. No. 3,634,515. Another class of dispersant is high molecular weight esters. These materials are similar to Mannich dispersants or the succinimides described below, except that they may be seen as having been prepared by reaction of a hydrocarbyl acylating agent and a polyhydric aliphatic alcohol such as glycerol, pentaerythritol, or sorbitol. Such materials are described in more detail in U.S. Pat. No. 3,381,022. Aromatic succinate esters may also be prepared as described in United States Patent Publication 2010/0286414. Other dispersants include polymeric dispersant additives, which are generally hydrocarbon-based polymers which contain polar functionality to impart dispersancy characteristics to the polymer.

In certain embodiments, the dispersant is prepared by a process that involves the presence of small amounts of chlorine or other halogen, as described in U.S. Pat. No. 7,615,521 (see, e.g., col. 4, lines 18-60 and preparative example A). Such dispersants typically have some carbocyclic structures in the attachment of the hydrocarbyl substituent to the acidic or amidic "head" group. In other embodiments, the dispersant is prepared by a thermal process involving an "ene" reaction, without the use of any chlorine or other halogen, as described in U.S. Pat. No. 7,615,521; dispersants made in this manner are often derived from high vinylidene (i.e. greater than 50% terminal vinylidene) polyisobutylene (see col. 4, line 61 to col. 5, line 30 and preparative example B). Such dispersants typically do not contain the above-described carbocyclic structures at the point of attachment. In certain embodiments, the dispersant is prepared by free radical catalyzed polymerization of high-vinylidene polyisobutylene with an ethylenically unsaturated acylating agent, as described in U.S. Pat. No. 8,067,347.

Dispersants may be derived from, as the polyolefin, high vinylidene polyisobutylene, that is, having greater than 50, 70, or 75% terminal vinylidene groups ($\alpha$ and $\beta$ isomers). In certain embodiments, a succinimide dispersant may be prepared by the direct alkylation route. In other embodiments it may comprise a mixture of direct alkylation and chlorine-route dispersants.

A preferred class of dispersants is the carboxylic dispersants. Carboxylic dispersants include succinic-based dispersants, which are the reaction product of a hydrocarbyl substituted succinic acylating agent with an organic hydroxy compound or, in certain embodiments, an amine containing at least one hydrogen attached to a nitrogen atom, or a mixture of said hydroxy compound and amine. The term "succinic acylating agent" refers to a hydrocarbon-substituted succinic acid or succinic acid-producing compound. Such materials typically include hydrocarbyl-substituted succinic acids, anhydrides, esters (including half esters) and halides. Succinimide dispersants are more fully described in U.S. Pat. Nos. 4,234,435 and 3,172,892.

Succinic based dispersants have a wide variety of chemical structures including typically structures such as

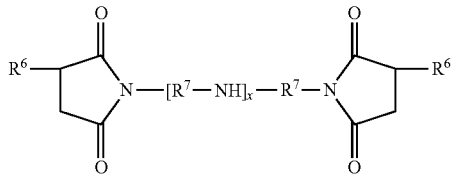

wherein each $R^6$ is independently a hydrocarbyl group, such as a polyolefin-derived group having an $\overline{M}_n$ of 500 or 700 to 10,000. Typically the hydrocarbyl group is an alkyl group, frequently a polyisobutyl group with a molecular weight of 500 or 700 to 5000, or in another embodiment, 1500 or 2000 to 5000. Alternatively expressed, the $R^6$ groups can contain 40 to 500 carbon atoms and in certain embodiments at least 50, e.g., 50 to 300 carbon atoms, such as aliphatic carbon atoms. Each $R^6$ group may contain one or more reactive groups, e.g., succinic groups. The $R^7$ are alkenyl groups, commonly $—C_2H_4—$ groups. Such molecules are commonly derived from reaction of an alkenyl acylating agent with a polyamine, and a wide variety of linkages between the two moieties is possible beside the simple imide structure shown above, including a variety of amides and quaternary ammonium salts.

The amines which are reacted with the succinic acylating agents to form the carboxylic dispersant composition can be monoamines or polyamines. Polyamines include principally alkylene polyamines such as ethylene polyamines (i.e., poly(ethyleneamine)s), such as ethylene diamine, triethylene tetramine, propylene diamine, decamethylene diamine, octamethylene diamine, di(heptamethylene) triamine, tripropylene tetramine, tetraethylene pentamine, trimethylene diamine, pentaethylene hexamine, di(-trimethylene) triamine. Higher homologues such as are obtained by condensing two or more of the above-illustrated alkylene amines likewise are useful. Tetraethylene pentamines are particularly useful.

Hydroxyalkyl-substituted alkylene amines, i.e., alkylene amines having one or more hydroxyalkyl substituents on the nitrogen atoms, likewise are useful, as are higher homologues obtained by condensation of the above-illustrated alkylene amines or hydroxy alkyl-substituted alkylene amines through amino radicals or through hydroxy radicals.

In one embodiment, the dispersant may be present as a single dispersant. In one embodiment, the dispersant may be present as a mixture of two or three different dispersants, wherein at least one may be a succinimide dispersant.

The succinimide dispersant may be a derivative of an aromatic amine, an aromatic polyamine, or mixtures thereof. The aromatic amine may be 4-aminodiphenylamine (ADPA) (also known as N-phenylphenylenediamine), derivatives of ADPA (as described in United States Patent Publications 2011/0306528 and 2010/0298185), a nitroaniline, an aminocarbazole, an amino-indazolinone, an aminopyrimidine, 4-(4-nitrophenylazo)aniline, or combinations thereof. In one embodiment, the dispersant is derivative of an aromatic amine wherein the aromatic amine has at least three non-continuous aromatic rings.

The succinimide dispersant may be a derivative of a polyether amine or polyether polyamine. Typical polyether amine compounds contain at least one ether unit and will be chain terminated with at least one amine moiety. The polyether polyamines can be based on polymers derived from C2-C6 epoxides such as ethylene oxide, propylene oxide, and butylene oxide. Examples of polyether polyamines are sold under the Jeffamine® brand and are commercially available from Huntsman Corporation located in Houston, Tex.

Post-treated dispersants may also be a part of the disclosed technology. They are generally obtained by reacting carboxylic, amine or Mannich dispersants with reagents such as urea, thiourea, carbon disulfide, aldehydes, ketones, carboxylic acids, hydrocarbon-substituted succinic anhydrides, nitriles, epoxides, boron compounds such as boric acid (to give "borated dispersants"), phosphorus compounds such as phosphorus acids or anhydrides, or 2,5-dimercaptothiadiazole (DMTD). Amine dispersants are reaction products of relatively high molecular weight aliphatic or alicyclic halides and amines such as polyalkylene polyamines. Examples thereof are described in U.S. Pat. Nos. 3,275,554, 3,438,757, 3,454,555 and 3,565,804. In certain embodiments one or more of the individual dispersants may be post-treated with boron or DMTD or with both boron and DMTD. Exemplary materials of these kinds are described in the following U.S. Pat. Nos. 3,200,107, 3,282,955, 3,367,943, 3,513,093, 3,639,242, 3,649,659, 3,442,808, 3,455,832, 3,579,450, 3,600,372, 3,702,757, and 3,708,422.

The amount of the dispersant in a completely formulated lubricant, if present, will typically be 0.05 or 0.5 to 10 percent by weight, or 1 to 8 percent by weight, or 3 to 7 percent by weight or 2 to 5 percent by weight. Its concentration in a concentrate will be correspondingly increased, to, e.g., 5 to 80 weight percent.

Detergents

Detergents are generally salts of organic acids, which are often overbased. Metal overbased salts of organic acids are widely known to those of skill in the art and generally include metal salts wherein the amount of metal present exceeds the stoichiometric amount. Such salts are said to have conversion levels in excess of 100% (i.e., they comprise more than 100% of the theoretical amount of metal needed to convert the acid to its "normal" or "neutral" salt). They are commonly referred to as overbased, hyperbased or super-based salts and are usually salts of organic sulfur acids, organic phosphorus acids, carboxylic acids, phenols or mixtures of two or more of any of these. As a skilled worker would realize, mixtures of such overbased salts can also be used.

The overbased compositions can be prepared based on a variety of well-known organic acidic materials including sulfonic acids, carboxylic acids (including substituted salicylic acids), phenols, phosphonic acids, saligenins, salixarates, and mixtures of any two or more of these. These materials and methods for overbasing of them are well known from numerous U.S. Patents.

The basically reacting metal compounds used to make these overbased salts are usually an alkali or alkaline earth metal compound, although other basically reacting metal compounds can be used. Compounds of Ca, Ba, Mg, Na and Li, such as their hydroxides and alkoxides of lower alkanols are usually used. Overbased salts containing a mixture of ions of two or more of these metals can be used in the present invention.

Overbased materials are generally prepared by reacting an acidic material (typically an inorganic acid or lower carboxylic acid, such as carbon dioxide) with a mixture comprising an acidic organic compound, a reaction medium comprising at least one inert, organic solvent (mineral oil, naphtha, toluene, xylene, etc.) for said acidic organic material, a stoichiometric excess of a metal base, and a promoter. The acidic organic compound will, in the present instance, be the above-described saligenin derivative.

The acidic material used in preparing the overbased material can be a liquid such as formic acid, acetic acid, nitric acid, or sulfuric acid. Acetic acid is particularly useful. Inorganic acidic materials can also be used, such as HCl, $SO_2$, $SO_3$, $CO_2$, or $H_2S$, e.g., $CO_2$ or mixtures thereof, e.g., mixtures of $CO_2$ and acetic acid.

Patents specifically describing techniques for making basic salts of acidic organic compounds generally include U.S. Pat. Nos. 2,501,731; 2,616,905; 2,616,911; 2,616,925; 2,777,874; 3,256,186; 3,384,585; 3,365,396; 3,320,162; 3,318,809; 3,488,284; and 3,629,109. Overbased saligenin derivatives are described in PCT publication WO 2004/048503; overbased salixarates are described in PCT publication WO 03/018728.

Overbased sulphonates typically have a TBN of 250 to 600, or 300 to 500. Overbased detergents are known in the art. In one embodiment the sulphonate detergent may be a predominantly linear alkylbenzene sulphonate detergent having a metal ratio of at least 8 as is described in paragraphs [0026] to [0037] of US Patent Application 2005065045 (and granted as U.S. Pat. No. 7,407,919). Linear alkyl benzenes may have the benzene ring attached anywhere on the linear chain, usually at the 2, 3, or 4 position, or mixtures thereof. The predominantly linear alkylbenzene sulphonate detergent may be particularly useful for assisting in improving fuel economy. In one embodiment the sulphonate detergent may be a metal salt of one or more oil-soluble alkyl toluene sulphonate compounds as disclosed in paragraphs [0046] to [0053] of US Patent Application 2008/0119378.

In one embodiment, the sulfonate detergent may be a branched alkylbenzene sulfonate detergent. Branched alkylbenzene sulfonate may be prepared from isomerized alpha olefins, oligomers of low molecular weight olefins, or combinations thereof. Preferred oligomers include tetramers, pentamers, and hexamers of propylene and butylene. In other embodiments, the alkylbenzene sulfonate detergent may be derived from a toluene alkylate, i.e. the alkylbenzene sulfonate has at least two alkyl groups, at least one of which is a methyl group, the other being a linear or branched alkyl group as described above.

In one embodiment the lubricating composition further comprises a non-sulphur containing phenate, or sulphur containing phenate, or mixtures thereof. The non-sulphur containing phenates and sulphur containing phenates are known in the art. The non-sulphur containing phenate, or sulphur containing phenate may be neutral or overbased. Typically an overbased non-sulphur containing phenate, or a sulphur containing phenate have a total base number of 180 to 450 TBN and a metal ratio of 2 to 15, or 3 to 10. A neutral non-sulphur containing phenate, or sulphur containing phenate may have a TBN of 80 to less than 180 and a metal ratio of 1 to less than 2, or 0.05 to less than 2.

The non-sulphur containing phenate, or sulphur containing phenate may be in the form of a calcium or magnesium non-sulphur containing phenate, or sulphur containing phenate (typically calcium non-sulphur containing phenate, or sulphur containing phenate). When present the non-sulphur containing phenate, or sulphur containing phenate may be present at 0.1 to 10 wt %, or 0.5 to 8 wt %, or 1 to 6 wt %, or 2.5 to 5.5 wt % of the lubricating composition.

In one embodiment the lubricating composition may be free of an overbased phenate, and in a different embodiment the lubricating composition may be free of a non-overbased phenate. In another embodiment the lubricating composition may be free of a phenate detergent.

Phenate detergents are typically derived from p-hydrocarbyl phenols. Alkylphenols of this type may be coupled with sulfur and overbased, coupled with aldehyde and overbased, or carboxylated to form salicylate detergents. Suitable alkylphenols include those alkylated with oligomers of propylene, i.e. tetrapropenylphenol (i.e. p-dodecylphenol or PDDP) and pentapropenylphenol. Other suitable alkylphenols include those alkylated with alpha-olefins, isomerized alpha-olefins, and polyolefins like polyisobutylene. In one embodiment, the lubricating composition comprises less than 0.2 wt %, or less than 0.1 wt %, or even less than 0.05 wt % of a phenate detergent derived from PDDP. In one embodiment, the lubricant composition comprises a phenate detergent that is not derived from PDDP. In one embodiment, the lubricating composition comprises a phenate detergent prepared from PDDP wherein the phenate detergent contains less than 1.0 weight percent unreacted PDDP, or less than 0.5 weight percent unreacted PDDP, or substantially free of PDDP.

In one embodiment the lubricating composition further comprises a salicylate detergent that may be neutral or overbased. The salicylates are known in the art. The salicylate detergent may have a TBN of 50 to 400, or 150 to 350, and a metal ratio of 0.5 to 10, or 0.6 to 2. Suitable salicylate detergents included alkylated salicylic acid, or alkylsalicylic acid. Alkylsalicylic acid may be prepared by alkylation of salicylic acid or by carbonylation of alkylphenol. When alkylsalicylic acid is prepared from alkylphenol, the alkylphenol is selected in a similar manner as the phenates described above. In one embodiment, alkylsalicylate of the invention include those alkylated with oligomers of propylene, i.e. tetrapropenylphenol (i.e. p-dodecylphenol or PDDP) and pentapropenylphenol. Other suitable alkylphenols include those alkylated with alpha-olefins, isomerized alpha-olefins, and polyolefins like polyisobutylene. In one embodiment, the lubricating composition comprises a salicylate detergent prepared from PDDP wherein the phenate detergent contains less than 1.0 weight percent unreacted PDDP, or less than 0.5 weight percent unreacted PDDP, or substantially free of PDDP.

When present the salicylate may be present at 0.01 to 10 wt %, or 0.1 to 6 wt %, or 0.2 to 5 wt %, 0.5 to 4 wt %, or 1 to 3 wt % of the lubricating composition.

The detergents generally can also be borated by treatment with a borating agent such as boric acid. Typical conditions include heating the detergent with boric acid at 100 to 150° C., the number of equivalents of boric acid being roughly equal to the number of equivalents of metal in the salt. U.S. Pat. No. 3,929,650 discloses borated complexes and their preparation.

The amount of the detergent component in a completely formulated lubricant, if present, will typically be 0.01 to 15 percent by weight or 0.5 to 10 percent by weight, such as 1 to 7 percent by weight, or 1.2 to 4 percent by weight. Its concentration in a concentrate will be correspondingly increased, to, e.g., 5 to 65 weight percent.

Additional Friction Modifiers

Additional friction modifiers may be used in the composition used in the present technology. Friction modifiers are well known to those skilled in the art. A list of friction modifiers that may be used is included in U.S. Pat. Nos. 4,792,410, 5,395,539, 5,484,543 and 6,660,695. U.S. Pat. No. 5,110,488 discloses metal salts of fatty acids and especially zinc salts, useful as friction modifiers. A list of friction modifiers that may be used may include: fatty phosphites; borated alkoxylated fatty amines; fatty acid amides; metal salts of fatty acids; fatty epoxides; sulfurized olefins; borated fatty epoxides; fatty imidazolines; fatty amines; condensation products of carboxylic acids and polyalkylenepolyamines; glycerol esters; metal salts of alkyl salicylates; borated glycerol esters; amine salts of alkylphosphoric acids; alkoxylated fatty amines; ethoxylated alcohols; oxazolines; imidazolines; hydroxyalkyl amides; polyhydroxy tertiary amines; and mixtures of two or more thereof.

Representatives of each of these types of friction modifiers are known and are commercially available. For instance, fatty phosphites may be generally of the formula $(RO)_2PHO$ or (RO)(HO)PHO where R may be an alkyl or alkenyl group of sufficient length to impart oil solubility. Suitable phosphites are available commercially and may be synthesized as described in U.S. Pat. No. 4,752,416.

Borated fatty epoxides that may be used are disclosed in Canadian Patent No. 1,188,704. These oil-soluble boron-containing compositions may be prepared by reacting a boron source such as boric acid or boron trioxide with a fatty epoxide which may contain at least 8 carbon atoms. Non-borated fatty epoxides may also be useful as supplemental friction modifiers.

Borated amines that may be used are disclosed in U.S. Pat. No. 4,622,158. Borated amine friction modifiers (including borated alkoxylated fatty amines) may be prepared by the reaction of a boron compounds, as described above, with the corresponding amines, including simple fatty amines and hydroxy containing tertiary amines. The amines useful for preparing the borated amines may include commercial alkoxylated fatty amines known by the trademark "ETHOMEEN" and available from Akzo Nobel, such as bis[2-hydroxyethyl]-cocoamine, polyoxyethylene[10]cocoamine, bis[2-hydroxyethyl]-soyamine, bis[2-hydroxyethyl]allowamine, polyoxyethylene-[5]tallowamine, bis[2-hydroxyethyl]oleylamine, bis[2-hydroxyethyl] octadecylamine, and polyoxyethylene[15]-octadecylamine. Such amines are described in U.S. Pat. No. 4,741,848.

Alkoxylated fatty amines and fatty amines themselves (such as oleylamine) may be useful as friction modifiers. These amines are commercially available.

Both borated and unborated fatty acid esters of glycerol may be used as friction modifiers. Borated fatty acid esters of glycerol may be prepared by borating a fatty acid ester of glycerol with a boron source such as boric acid. Fatty acid esters of glycerol themselves may be prepared by a variety of methods well known in the art. Many of these esters, such as glycerol monooleate and glycerol tallowate, are manufactured on a commercial scale. Commercial glycerol monooleates may contain a mixture of 45% to 55% by weight monoester and 55% to 45% by weight diester.

Fatty acids may be used in preparing the above glycerol esters; they may also be used in preparing their metal salts, amides, and imidazolines, any of which may also be used as friction modifiers. The fatty acids may contain 6 to 24 carbon atoms, or 8 to 18 carbon atoms. A useful acid may be oleic acid.

The amides of fatty acids may be those prepared by condensation with ammonia or with primary or secondary amines such as diethylamine and diethanolamine. Fatty imidazolines may include the cyclic condensation product of an acid with a diamine or polyamine such as a polyethylenepolyamine. In one embodiment, the friction modifier may be the condensation product of a C8 to C24 fatty acid with a polyalkylene polyamine, for example, the product of isostearic acid with tetraethylenepentamine. The condensation products of carboxylic acids and polyalkyleneamines may be imidazolines or amides.

The fatty acid may also be present as its metal salt, e.g., a zinc salt. These zinc salts may be acidic, neutral, or basic (overbased). These salts may be prepared from the reaction of a zinc containing reagent with a carboxylic acid or salt thereof. A useful method of preparation of these salts is to react zinc oxide with a carboxylic acid. Useful carboxylic acids are those described hereinabove. Suitable carboxylic acids include those of the formula RCOOH where R is an aliphatic or alicyclic hydrocarbon radical. Among these are those wherein R is a fatty group, e.g., stearyl, oleyl, linoleyl, or palmityl. Also suitable are the zinc salts wherein zinc is present in a stoichiometric excess over the amount needed to prepare a neutral salt. Salts wherein the zinc is present from 1.1 to 1.8 times the stoichiometric amount, e.g., 1.3 to 1.6 times the stoichiometric amount of zinc, may be used. These zinc carboxylates are known in the art and are described in U.S. Pat. No. 3,367,869. Metal salts may also include calcium salts. Examples may include overbased calcium salts.

Sulfurized olefins are also well known commercial materials used as friction modifiers. A suitable sulfurized olefin is one which is prepared in accordance with the detailed teachings of U.S. Pat. Nos. 4,957,651 and 4,959,168. Described therein is a cosulfurized mixture of 2 or more reactants selected from the group consisting of at least one fatty acid ester of a polyhydric alcohol, at least one fatty acid, at least one olefin, and at least one fatty acid ester of a monohydric alcohol. The olefin component may be an aliphatic olefin, which usually will contain 4 to 40 carbon atoms. Mixtures of these olefins are commercially available. The sulfurizing agents useful in the process of the present invention include elemental sulfur, hydrogen sulfide, sulfur halide plus sodium sulfide, and a mixture of hydrogen sulfide and sulfur or sulfur dioxide.

Metal salts of alkyl salicylates include calcium and other salts of long chain (e.g. C12 to C16) alkyl-substituted salicylic acids.

Amine salts of alkylphosphoric acids include salts of oleyl and other long chain esters of phosphoric acid, with amines such as tertiary-aliphatic primary amines, sold under the tradename Primene™.

Eighty-five percent phosphoric acid is a suitable material for addition to the fully-formulated compositions to increase frictional properties and can be included at a level of 0.01-0.3 weight percent based on the weight of the composition, such as 0.03 to 0.2 or to 0.1 percent.

The amount of additional friction modifier, if it is present, may be 0.01 to 10 or 5 percent by weight of the lubricating composition or 0.1 to 2.5 percent by weight of the lubricating composition, such as 0.1 to 2.0, 0.2 to 1.75, 0.3 to 1.5 or 0.4 to 1 percent. In some embodiments, however, the amount of additional friction modifier is present at less than 0.2 percent or less than 0.1 percent by weight, for example, 0.01 to 0.1 percent.

Viscosity Modifiers

Other additives may be present in the lubricants of the disclosed technology. One component frequently used is a viscosity modifier. Viscosity modifiers (VM) and dispersant viscosity modifiers (DVM) are well known. Examples of VMs and DVMs may include polymethacrylates, polyacrylates, polyolefins, styrene-maleic ester copolymers, and similar polymeric substances including homopolymers, copolymers, and graft copolymers. Examples of viscosity modifiers include hydrogenated styrene-butadiene rubbers, ethylene-propylene copolymers, hydrogenated styrene-isoprene polymers, hydrogenated diene polymers, polyalkyl styrenes, polyalkyl (meth)acrylates and esters of maleic anhydride-styrene copolymers, or mixtures thereof. The DVM may comprise a nitrogen-containing methacrylate polymer, for example, a nitrogen-containing methacrylate polymer derived from methyl methacrylate and dimethylaminopropylamine.

Examples of commercially available VMs, DVMs and their chemical types may include the following: polyisobutylenes (such as Indopol™ from BP Amoco or Parapol™ from ExxonMobil); olefin copolymers (such as Lubrizol™ 7060, 7065, and 7067 from Lubrizol and Lucant™ HC-2000L and HC-600 from Mitsui); hydrogenated styrene-diene copolymers (such as Shellvis™ 40 and 50, from Shell and LZ® 7308, and 7318 from Lubrizol); styrene/maleate copolymers, which are dispersant copolymers (such as LZ® 3702 and 3715 from Lubrizol); polymethacrylates, some of which have dispersant properties (such as those in the Viscoplex™ series from RohMax, the Hitec™ series from Afton, and LZ 7702™, LZ 7727™, LZ 7725™ and LZ 7720C™ from Lubrizol); olefin-graft-polymethacrylate polymers (such as Viscoplex™ 2-500 and 2-600 from RohMax); and hydrogenated polyisoprene star polymers (such as Shellvis™ 200 and 260, from Shell). Also included are Asteric™ polymers from Lubrizol (methacrylate polymers with radial or star architecture). Viscosity modifiers that may be used are described in U.S. Pat. Nos. 5,157,088, 5,256,752 and 5,395,539. The VMs and/or DVMs may be used in the functional fluid at a concentration of up to 20% or 60% or 70% by weight. Concentrations of 0.1 to 12%, 0.1 to 4%, 0.2 to 3%, 1 to 12% or 3 to 10% by weight may be used.

Antioxidants

Other materials can optionally be included in the compositions of the present technology, provided that they are not incompatible with the afore-mentioned required components or specifications. Such materials include antioxidants (that is, oxidation inhibitors), including hindered phenolic antioxidants, molybdenum dithiocarbamates, secondary aromatic amine antioxidants such as dinonyldiphenylamine as well as such well-known variants as monononyldiphenylamine and diphenylamines with other alkyl substituents such as mono- or di-ocyl, sulfurized phenolic antioxidants, oil-soluble copper compounds, phosphorus-containing antioxidants, and organic sulfides, disulfides, and polysulfides such as 2-hydroxyalkyl, alkyl thioethers or 1-t-dodecylthio-2-propanol or sulfurized 4-carbobutoxycyclohexene or other sulfurized olefins. Antioxidant compounds maybe used alone or in combination.

The hindered phenol antioxidant often contains a secondary butyl and/or a tertiary butyl group as a sterically hindering group. The phenol group is often further substituted with a hydrocarbyl group and/or a bridging group linking to a second aromatic group. Examples of suitable hindered phenol antioxidants include 2,6-di-tert-butylphenol, 4-methyl-2,6-di-tert-butylphenol, 4-ethyl-2,6-di-tert-butylphenol, 4 propyl-2,6-di-tert-butylphenol or 4-butyl-2,6-di-tert-butylphenol, or 4-dodecyl-2,6-di-tert-butylphenol. In one embodiment the hindered phenol antioxidant is an ester and may include, e.g., Irganox™ L-135 from Ciba. Suitable examples of molybdenum dithiocarbamates which may be used as an antioxidant include commercial materials sold under the trade names such as Vanlube 822™ and Molyvan™ A from R. T. Vanderbilt Co., Ltd., and Adeka Sakura-Lube™ S-100, S-165 and S-600 from Asahi Denka Kogyo K. K and mixtures thereof.

The amount of anti-oxidant, if it is present, may be 0.01 to 5 or 3 percent by weight of the lubricating composition or 0.3 to 1.2 percent by weight of the lubricating composition, such as 0.5 to 1.2, 0.6 to 1.0 or 0.7 to 0.9 or 0.15 to 4.5, or 0.2 to 4 percent by weight.

Other Additives

The compositions of the present invention may also include, or exclude, conventional amounts of other components which are commonly found in lubricating compositions.

Also included may be corrosion inhibitors or metal deactivators such as tolyl triazole and dimercaptothiadiazole and oil-soluble derivatives of such materials. These include derivatives of benzotriazole (typically tolyltriazole), 1,2,4-triazole, benzimidazole, 2-alkyldithiobenzimidazole or 2-alkyldithiobenzothiazole, 1-amino-2-propanol, a derivative of dimercaptothiadiazole, octylamine octanoate, condensation products of dodecenyl succinic acid or anhydride and/or a fatty acid such as oleic acid with a polyamine.

Other optional components include additional seal swell additives, such as isodecyl sulfolane or phthalate esters, which are designed to keep seals pliable.

Other materials are additional anti-wear agents such as other phosphorus-containing materials such as phosphorus acids, salts, esters or derivatives thereof include phosphoric acid, phosphorous acid, phosphorus acid esters or salts thereof, phosphites, phosphorus-containing amides, phosphorus-containing carboxylic acids or esters, phosphorus-containing ethers, and mixtures thereof. Other antiwear agents include tridecyl adipate, and various long-chain derivatives of hydroxy carboxylic acids, such as tartrates, tartramides, tartrimides, and citrates as described in US Application 2006-0183647. These optional materials are known to those skilled in the art and are generally commercially available. Yet other commercially available anti-wear agents include dimercaptothiadiazoles and their derivatives, which are described in greater detail in published European Patent Application 761,805.

Also included can be known materials such as, demulsifiers dyes, fluidizing agents, odor masking agents, and antifoam agents. Demulsifiers include trialkyl phosphates, and various polymers and copolymers of ethylene glycol, ethylene oxide, propylene oxide, or mixtures thereof different from the non-hydroxy terminated acylated polyether of the disclosed technology. Anti-foam agents used to reduce or prevent the formation of stable foam include silicones or organic polymers. Examples of these and additional anti-foam compositions are described in "Foam Control Agents", by Henry T. Kerner (Noyes Data Corporation, 1976), pages 125-162. Foam inhibitors that may be useful in the compositions of the disclosed technology include polysiloxanes, copolymers of ethyl acrylate and 2-ethylhexylacrylate and optionally vinyl acetate; demulsifiers including fluorinated polysiloxanes, trialkyl phosphates, polyethylene glycols, polyethylene oxides, polypropylene oxides and (ethylene oxide-propylene oxide) polymers.

Also included may be extreme pressure agents, chlorinated aliphatic hydrocarbons; boron-containing compounds including organic borate esters and organic borate salts; and molybdenum compounds. Extreme Pressure (EP) agents include sulphur- and chloro-sulphur-containing EP agents, chlorinated hydrocarbon EP agents and phosphorus EP agents. Examples of such EP agents include chlorinated wax; sulphurised olefins (such as sulphurised isobutylene), organic sulphides and polysulphides such as dibenzyldisulphide, bis-(chlorobenzyl) disulphide, dibutyl tetrasulphide, sulphurised methyl ester of oleic acid, sulphurised alkylphenol, sulphurised dipentene, sulphurised terpene, and sulphurised Diels-Alder adducts; phosphosulphurised hydrocarbons such as the reaction product of phosphorus sulphide with turpentine or methyl oleate; phosphorus esters such as the dihydrocarbon and trihydrocarbon phosphites, e.g., dibutyl phosphite, diheptyl phosphite, dicyclohexyl phosphite, pentylphenyl phosphite; dipentylphenyl phosphite, tridecyl phosphite, distearyl phosphite and polypropylene substituted phenol phosphite; metal thiocarbamates such as zinc dioctyldithiocarbamate and barium heptylphenol diacid; amine salts of alkyl and dialkylphosphoric acids or derivatives including, for example, the amine salt of a reaction product of a dialkyldithiophosphoric acid with propylene oxide and subsequently followed by a further reaction with $P_2O_5$; and mixtures thereof (as described in U.S. Pat. No. 3,197,405). The polysulphides are generally characterized as having sulphur-sulphur linkages. Typically the linkages have about 2 to about 8 sulphur atoms, or about 2 to about 6 sulphur atoms, or 2 to about 4 sulphur atoms. In one embodiment the polysulphide contains at least about 20 wt %, or at least about 30 wt % of the polysulphide molecules contain three or more sulphur atoms. In one embodiment at least about 50 wt % of the polysulphide molecules are a mixture of tri- or tetra-sulphides. In other embodiments at least about 55 wt %, or at least about 60 wt % of the polysulphide molecules are a mixture of tri- or tetra-sulphides. In one embodiment up to about 90 wt % of the polysulphide molecules are a mixture of tri- or tetra-sulphides. In other embodiments up to about 80 wt % of the polysulphide molecules are a mixture of tri- or tetra-sulphides. The polysulphide in other embodiments contain about 0 wt % to about 20 wt %, or about 0.1 to about 10 wt % of a penta- or higher polysulphide. In one embodiment the polysulphide contains less than about 30 wt % or less than about 40 wt % of a disulphide in the polysulphide. The polysulphide typically provides about 0.5 to about 5 wt %, or about 1 to about 3 wt %, of sulphur to the lubricating composition.

Pour point depressants are a particularly useful type of additive, often included in the lubricating oils described herein, usually comprising substances such as polymethacrylates, styrene-based polymers, crosslinked alkyl phenols, or alkyl naphthalenes. See for example, page 8 of "Lubricant Additives" by C. V. Smalheer and R. Kennedy Smith (Lesius-Hiles Company Publishers, Cleveland, Ohio, 1967). Pour point depressants that may be useful in the compositions of the disclosed technology also include polyalphaolefins, esters of maleic anhydride-styrene copolymers, polyacrylates, polymethacrylates or polyacrylamides.

Additional antioxidants can also be included, typically of the aromatic amine or hindered phenol type. These and other additives which may be used in combination with the present invention are described in greater detail in U.S. Pat. No. 4,582,618 (column 14, line 52 through column 17, line 16, inclusive).

The compound of formula (I) may be suitable for use in lubricating compositions such as an engine lubricant for an internal combustion engine or a lubricating composition for a driveline device such as a gear oil, axle oil, drive shaft oil, traction oil, manual transmission oils, automatic transmission oils, off-highway oils (such as tractor oils) or as an automotive gear oil (AGO).

Lubricating Composition for an Engine

In one embodiment the lubricating composition is a lubricant for an internal combustion engine, i.e. a crankcase lubricant. The compound of formula (I) is used as an anti-wear agent in said composition.

The internal combustion engine may comprise a steel surface, for example, on a cylinder bore, a cylinder block or a piston ring. The internal combustion engine may be a motorcycle, a passenger car, a heavy duty diesel internal combustion engine or a 2-stroke or 4-stroke marine diesel engine.

The lubricating composition can have at least one of: (i) a sulphur content of up to and including 0.5 wt %, less than 0.5 wt % or from 0.1 to 0.4 wt %; (ii) a phosphorus content of up to and including 0.15 wt %, less than 1.5 wt % or from 0.01 or 0.03 to 0.08 or 0.10 or 0.12 wt %; and (iii) a sulphated ash content of 0.5 wt % to 1.1 or 1.5 wt % of the lubricating composition.

A typical crankcase lubricant may contain an oil of lubricating viscosity, for example a Group I, Group II, Group III mineral oil or combinations thereof, with a kinematic viscosity of 3.6 to 7.5 $mm^2/s$, or 3.8 to 5.6 $mm^2/s$, or 4.0 to 4.8 $mm^2/s$.

In addition to the compound of formula (I) as described herein, the engine lubricating composition may further include other additives, for example, selected from those described above, in the amounts indicated above. In one embodiment the disclosed technology provides a lubricating composition further comprising at least one of an overbased detergent (including, for example, overbased sulphonates and phenates), an antioxidant (including, for example, phenolic and aminic antioxidants), an additional friction modifier, a corrosion inhibitor, a dispersant (typically a polyisobutylene succinimide dispersant), a dispersant viscosity modifier, a viscosity modifier (typically an olefin copolymer such as an ethylene-propylene copolymer, or mixtures thereof. In one embodiment the disclosed technology provides a lubricating composition comprising a compound of formula (I) and further comprising an overbased detergent, an antioxidant, an additional friction modifier and a corrosion inhibitor.

Suitable overbased detergents are described in the "Detergents" section above. The engine oil lubricating composition of the invention can comprise an overbased detergent chosen from non-sulphur-containing phenates, sulphur-containing phenates, sulphonates, salixarates, salicyclates and mixtures thereof, or borated equivalents and mixture of borated equivalents thereof. The overbased detergent may be present at 0 wt % to 15 wt %, or 0.1 wt % to 10 wt %, or 0.2 wt % to 8 wt %, or 0.2 wt % to 3 wt %. For example in a heavy duty diesel engine the detergent may be present at 2 wt % to 3 wt % of the lubricating composition. For a passenger car engine the detergent may be present at 0.2 wt % to 1 wt % of the lubricating composition. In one embodiment, an engine lubricating composition further comprises at least one overbased detergent with a metal ratio of at least 3, or at least 8, or at least 15.

In one embodiment an engine lubricating composition may be a lubricating composition further comprising at least one additional antiwear agent. Suitable additional anti-wear agents are described in the "Other additives" section above and also include titanium compounds, tartaric acid derivatives such as tartrate esters, amides or tartrimides, malic acid derivatives, citric acid derivatives, glycolic acid derivatives, oil soluble amine salts of phosphorus compounds, sulphurised olefins, metal dihydrocarbyldithiophosphates (such as zinc dialkyldithiophosphates), phosphites (such as dibutyl phosphite), phosphonates, thiocarbamate-containing compounds, such as thiocarbamate esters, thiocarbamate amides, thiocarbamic ethers, alkylene-coupled thiocarbamates, and bis(S-alkyldithiocarbamyl) disulphides. The additional antiwear agent many be a phosphorus-containing antiwear agent. Typically the phosphorus-containing antiwear agent may be a zinc dialkyldithiophosphate, a phosphite, a phosphate, a phosphonate, and an ammonium phosphate salt, or mixtures thereof. Zinc dialkyldithiophosphates are known in the art. The additional antiwear agent may be present at 0 wt % to 6 wt %, 0 wt % to 3 wt %, or 0.1 wt % to 1.5 wt %, or 0.5 wt % to 0.9 wt % of the lubricating composition.

The composition can comprise a molybdenum compound. The molybdenum compound may be an additional antiwear agent or an antioxidant. The molybdenum compound may be selected from the group consisting of molybdenum dialkyldithiophosphates, molybdenum dithiocarbamates, amine salts of molybdenum compounds, and mixtures thereof. The molybdenum compound may provide the lubricating composition with 0 to 1000 ppm, or 5 to 1000 ppm, or 10 to 750 ppm 5 ppm to 300 ppm, or 20 ppm to 250 ppm of molybdenum.

Suitable antioxidants are described above under "Antioxidants". Antioxidants include sulphurised olefins, diarylamines, alkylated diaryl amines, hindered phenols, molybdenum compounds (such as molybdenum dithiocarbamates), hydroxyl thioethers, or mixtures thereof. In one embodiment the lubricant composition includes an antioxidant, or mixtures thereof. The antioxidant may be present at 0 wt % to 10 wt %, or 0.1 wt % to 6 wt %, or 0.5 wt % to 5 wt %, or 0.5 wt % to 3 wt %, or 0.3 wt % to 1.5 wt % of the lubricant composition.

Suitable additional friction modifiers are described above under "Additional Friction Modifiers". Engine oil lubricants (i.e. crankcase lubricants), often include friction modifying additives that reduce dynamic friction between two surfaces, typically steel surfaces; this is carried out largely to improve fuel economy. Additives of this type are often referred to as "fatty" and include fatty acids, esters, amides, imides, amines, and combinations thereof. Examples of suitable friction reducing additives include glycerol mono-oleate, oleyl amide, ethoxylated tallow amine, oleyl tartrimide, fatty alkyl esters of tartaric acid, oleyl malimide, fatty alkyl esters of malic acid and combinations thereof. Alternatively, molybdenum additives may be used to reduce friction and improve fuel economy. Examples of molybdenum additives include dinuclear molybdenum dithiocarbamate complexes, for example Sakuralube™ 525 available from Adeka corp.; trinuclear molybdenum dithiocarbamate complexes; molybdenum amines, for example Sakuralube™ 710 available from Adeka corp.; mononuclear molybdenum dithiocarbamate complexes; molybdenum ester/amide additives, for example Molyvan® 855 available from Vanderbilt Chemicals, LLC; molybdated dispersants; and combinations thereof.

Useful corrosion inhibitors for an engine lubricating composition are described above and include those described in paragraphs 5 to 8 of WO2006/047486, octylamine octanoate, condensation products of dodecenyl succinic acid or anhydride and a fatty acid such as oleic acid with a polyamine. In one embodiment the corrosion inhibitors include the Synalox® corrosion inhibitor. The Synalox® corrosion inhibitor may be a homopolymer or copolymer of propylene oxide. The Synalox® corrosion inhibitor is described in more detail in a product brochure with Form No. 118-01453-0702 AMS, published by The Dow Chemical Company. The product brochure is entitled "SYNALOX Lubricants, High-Performance Polyglycols for Demanding Applications."

Suitable dispersants are described above under "Dispersants". In one embodiment, the composition comprises a succinimide dispersant and this can be a borated or non-borated succinimide dispersant.

Suitable viscosity modifiers and dispersant viscosity modifiers are described above under "Viscosity modifiers". In one embodiment the lubricating composition of the disclosed technology further comprises a dispersant viscosity modifier. The dispersant viscosity modifier may be present at 0 wt % to 10 wt %, 0 wt % to 5 wt %, or 0 wt % to 4 wt %, or 0.05 wt % to 2 wt %, or 0.2 wt % to 1.2 wt % of the lubricating composition.

The engine lubricating composition may also comprise a foam inhibitor, pour point depressant, demulsifier, metal deactivator or additional seal swell agent or mixtures thereof. Suitable candidates are described above under "other additives".

In one embodiment the lubricating composition comprises a compound of formula (I) in an amount 0.01 to 6 or 15 weight percent of the composition; at least one ashless dispersant in an amount 0.5 to 6 weight percent; at least one metal containing overbased detergent in an amount 0.5 to 3 weight percent of the composition; a sulfur- and phosphorus-free organic additional anti-wear agent, and mixtures thereof in an amount 0 or 0.01 to 2 weight percent of the composition; at least one ashless antioxidant (selected from hindered phenols and/or diarylamines) in an amount 0.2 to 5 weight percent of the composition; a polymeric viscosity index improver in an amount 0.0 to 6 weight percent of the composition and, optionally, one or more additional additives selected from corrosion inhibitors, foam inhibitors, seal swell agents, and pourpoint depressants.

An engine lubricating composition in different embodiments may have a composition as disclosed in the following table:

TABLE 2

| | Embodiments (wt %) | | |
|---|---|---|---|
| Additive | A | B | C |
| Compound of formula (I) | 0 or 0.05 to 6 | 0.05 to 4 | 0.1 to 2 |
| Ashless Dispersant | 0.05 to 10 | 0.75 to 6 | 1.5 to 5 |
| Antioxidant | 0.05 to 10 | 0.2 to 3 | 0.5 to 2 |
| Dispersant Viscosity Modifier | 0 or 0.05 to 5 | 0 or 0.05 to 4 | 0.05 to 2 |
| Overbased Detergent | 0 or 0.05 to 15 | 0.1 to 6 | 0.5 to 3 |
| Additional Friction Modifier | 0 or 0.05 to 10 | 0.5 to 8 | 1 to 6 |
| Viscosity Modifier | 0 or 0.05 to 10 | 0 or 0.05 to 8 | 0 or 0.05 to 6 |
| Any Other Performance Additive | 0.05 to 2 | 0.1 to 1.2 | 0.25 to 0.75 |
| Oil of Lubricating Viscosity | Balance to 100% | Balance to 100% | Balance to 100% |

Lubricating Composition for a Driveline Device

In another embodiment, the lubricating composition may suitable for lubricating a driveline device such as a manual transmission, automatic transmission, axle, gear or drive shaft. The compound of formula (I) is used as an anti-wear agent in said composition. In one embodiment the driveline device is a gear and the composition is thus a gear oil.

A lubricating composition for a driveline device may have a sulphur-content of greater than 0.05 wt %, or 0.4 wt % to 5 wt %, or 0.5 wt % to 3 wt %, 0.8 wt % to 2.5 wt %, 1 wt % to 2 wt %, 0.075 wt % to 0.5 wt %, or 0.1 wt % to 0.25 wt % of the lubricating composition.

A lubricating composition for a driveline device may have a phosphorus content of 100 ppm to 5000 ppm, or 200 ppm to 4750 ppm, 300 ppm to 4500 ppm, or 450 ppm to 4000 ppm. The phosphorus content may be 400 to 2000 ppm, or 400 to 1500 ppm, or 500 to 1400 ppm, or 400 to 900 ppm, or 500 to 850 ppm or 525 to 800 ppm.

In addition to the compound of formula (I) as described herein, the driveline lubricating composition may include further additives, for example, selected from those described above, in the amounts described above. In one embodiment the further additives comprise at least one of metal deactivators, detergents, dispersants, viscosity modifiers, additional friction modifiers, corrosion inhibitors, dispersant viscosity modifiers, antiwear agents, extreme pressure agents, antiscuffing agents, antioxidants, foam inhibitors, demulsifiers, pour point depressants, seal swelling agents and mixtures thereof. In one embodiment, the disclosed technology provides a lubricating composition further comprising at least one of a viscosity modifier (typically a polymethacrylate having linear, comb or star architecture), an overbased detergent (including, for example, overbased sulphonates, phenates and salicylates), a dispersant, a friction modifier, an antioxidant (including, for example, phenolic and aminic antioxidants), a dispersant viscosity modifier, and mixtures thereof. In one embodiment, the disclosed technology provides a lubricating composition comprising a compound of formula (I), an oil of lubricating viscosity and further comprising: a viscosity modifier; at least one of a dispersant and an overbased detergent; and optionally an additional friction modifier.

Additional antiwear agents may be included, such as those described in the "Other additives" section above, and include an oil soluble phosphorus amine salt antiwear agent such as an amine salt of a phosphorus acid ester or mixtures thereof. The amine salt of a phosphorus acid ester includes phosphoric acid esters and amine salts thereof; dialkyldithiophosphoric acid esters and amine salts thereof; phosphites; and amine salts of phosphorus-containing carboxylic esters, ethers, and amides; hydroxy substituted di or tri esters of phosphoric or thiophosphoric acid and amine salts thereof; phosphorylated hydroxy substituted di or tri esters of phosphoric or thiophosphoric acid and amine salts thereof; and mixtures thereof. The amine salt of a phosphorus acid ester may be used alone or in combination. In one embodiment the oil soluble phosphorus amine salt includes partial amine salt-partial metal salt compounds or mixtures thereof. In one embodiment the phosphorus compound further includes a sulphur atom in the molecule. Examples of the antiwear agent may include a non-ionic phosphorus compound (typically compounds having phosphorus atoms with an oxidation state of +3 or +5). In one embodiment the amine salt of the phosphorus compound may be ashless, i.e., metal-free (prior to being mixed with other components). The amines which may be suitable for use as the amine salt include primary amines, secondary amines, tertiary amines, and mixtures thereof. The amines include those with at least one hydrocarbyl group, or, in certain embodiments, two or three hydrocarbyl groups. The hydrocarbyl groups may contain 2 to 30 carbon atoms, or in other embodiments 8 to 26, or 10 to 20, or 13 to 19 carbon atoms. Suitable viscosity modifiers and dispersant viscosity modifiers are described above under "Viscosity modifiers". Viscosity modifiers are usually polymers, including polyisobutenes, polymethacrylic acid esters, diene polymers, poly-alkylstyrenes, esterified styrene-maleic anhydride copolymers, alkenylarene-conjugated diene copolymers, and polyolefins. Multifunctional viscosity improvers, which also have dispersant and/or antioxidancy properties are known and may optionally be used. The amount of viscosity modifier may range from 0.1 to 70 wt %, or 1 to 50 wt %, or 2 to 40 wt %. %. In an automotive gear oil, for example, the viscosity modifier and/or dispersant viscosity modifier may be present in the lubricating composition in an amount of 5 to 60 wt %, or 5 to 50 wt %, or 5 to 40 wt %, or 5 to 30 wt % or 5-20 wt %. Typically the viscosity modifier may be a polymethacrylate, or mixtures thereof.

A driveline device lubricating composition may contain a detergent such as described above under "Detergents". A driveline device lubricating composition may contain an overbased detergent that may or may not be borated. For example the lubricating composition may contain a borated overbased calcium or magnesium sulphonate detergent, or mixtures thereof. Suitable overbased detergents are described in the "Detergents" section above. The lubricating composition of the invention can comprise an overbased detergent chosen from non-sulphur-containing phenates, sulphur-containing phenates, sulphonates, salixarates, salicyclates and mixtures thereof, or borated equivalents and mixture of borated equivalents thereof. In an automotive gear oil, for example, the detergent may be present in the lubricating composition in an amount of 0.05 to 1 wt %, or 0.1 to 0.9 wt %. In a manual transmission fluid, for example, the detergent may be present in the lubricating composition in an amount of at least 0.1%, e.g., 0.14 to 4 wt %, or 0.2 to 3.5 wt %, or 0.5 to 3 wt %, or 1 to 2 wt %, or 0.5 to 4 wt %, or 0.6 to 3.5 wt % or, 1 to 3 wt %, or at least 1 wt 5, e.g., 1.5 to 2.8 wt %. In one embodiment, the composition can comprise one or more detergents containing calcium. In this embodiment, the total amount of calcium provided by the detergent(s) to the lubricant may be 0.03 to 1 wt %, or 0.1 to 0.6 wt %, or 0.2 to 0.5 wt %.

Suitable dispersants are described above under "Dispersants". The dispersant may be a succinimide dispersant. In one embodiment the succinimide dispersant may be an N-substituted long chain alkenyl succinimide. The long chain alkenyl succinimide may include polyisobutylene succinimide, wherein the polyisobutylene from which it is derived has a number average molecular weight in the range 350 to 5000, or 500 to 3000, or 750 to 1150. In one embodiment the dispersant for a driveline device may be a post treated dispersant. The dispersant may be post treated with dimercaptothiadiazole, optionally in the presence of one or more of a phosphorus compound, a dicarboxylic acid of an aromatic compound, and a borating agent. In an automotive gear oil, or in a manual transmission fluid, for example, the dispersant may be present in the lubricating composition in an amount of at least 0.1 wt %, or at least 0.3 wt %, or at least 0.5 wt % and at most 5 wt % or 4 wt % or 3 wt % of 2 wt %.

Suitable additional friction modifiers are described above under "Additional Friction Modifiers". Suitable additional friction modifiers include:

an amide, or thio amide, represented by the formula $R^3C(X)NR^1R^2$ where X is O or S and $R^1$ and $R^2$ are each independently hydrocarbyl groups of at least 6 (or 8 to 24 or 10 to 18) carbon atoms and $R^3$ is a hydroxyalkyl group of 1 to 6 carbon atoms or a group formed by the condensation of the hydroxyalkyl group, through a hydroxyl group thereof, with an acylating agent;

a tertiary amine being represented by the formula $R^4R^5NR^6$ wherein $R^4$ and $R^5$ are each independently alkyl groups of at least 6 carbon atoms and $R^6$ is a polyhydroxy-containing alkyl group or a polyhydroxy-containing alkoxy-alkyl group;

N-substituted oxalic acid bisamide or amide-ester containing at least two hydrocarbyl groups of about 12 to about 22 (or 12 to 20 or 12 to 18 or 12 to 16 or 12 to 14 or 14 to 20 or 14 to 18 or 14 to 16) carbon atoms carbon atoms;

fatty imidazolines such as the cyclic condensation product of an acid with a diamine or polyamine such as a polyethylenepolyamine and, in one embodiment, the friction modifier may be the condensation product of a C8 to C24 fatty acid with a polyalkylene polyamine, for example, the product of isostearic acid with tetra-ethylenepentamine (the condensation products of carboxylic acids and poly-alkyleneamines may be imidazolines or amides);

friction modifiers consisting of the reaction product of a carboxylic acid or a reactive equivalent thereof with an aminoalcohol, selected from the group consisting of tris-hydroxymethylaminomethane, 2-amino-2-ethyl-1,3-propanediol, 3-amino-1-propanol, 2-amino-1-propanol, 1-amino-2-propanol, 2-amino-2-methyl-1-propanol, 4-amino-1-butanol, 5-amino-1-pentanol, 2-amino-1-pentanol, 2-amino-1,2-propanediol, 2-amino-1,3-propanediol, 2-amino-2-methyl-1,3-propanediol, N-(2-hydroxyethyl)ethylenediamine, N,N-bis(2-hydroxyethyl)ethylenediamine, 1,3-diamino-2-hydroxypropane, N,N'-bis-(2-hydroxyethyl) ethylenediamine, and 1-aminopropyl-3-diisopropanol amine, wherein the friction modifier contains at least two branched chain alkyl groups, each containing at least 6 carbon atoms;

sulfurized olefins, such as sulfurized vegetable oil, lard oil or C16-18 olefins;

borate esters from the reaction product of boron trioxide and an epoxide having at least 8 carbon atoms, or 10 to 20 carbon atoms or comprises a straight chain hydrocarbyl group of 14 carbon atoms (see U.S. Pat. No. 4,584,115) and borate esters formed by the reaction of an alcohol and boric acid, wherein the alcohol is typically branched, & of C6 to C10, or C8 to C10 or C8;

ethoxylated amines;

phosphorus containing compounds such as phosphoric acid (e.g., 85% phosphoric acid, aqueous) as friction stabilizer and di-(fatty) alkyl phosphites; and metal salts of fatty acids. Friction modifiers (other than (a) a borated phospho-lipid, and (b) an amine salt of a phosphoric acid ester) also include fatty phosphonate esters, reaction products from fatty carboxylic acids reacted with guanidine, aminoguanidine, urea or thiourea, and salts thereof, fatty amines, esters such as borated glycerol esters, fatty phosphites, fatty acid amides, fatty epoxides, borated fatty epoxides, alkoxylated fatty amines, borated alkoxylated fatty amines, metal salts of fatty acids, or fatty imidazolines, condensation products of carboxylic acids and polyalkylene-polyamines. In an automotive or axle gear oil, for example, the additional friction modifier may be present in the lubricating composition in an amount of 1 to 5 wt %, or 2 to 4 wt %, or 2 to 3.5 wt %.

Suitable antioxidants are described above under "Antioxidants". Antioxidants include sulphurised olefins, diarylamines, alkylated diaryl amines, hindered phenols, molybdenum compounds (such as molybdenum dithiocarbamates), hydroxyl thioethers, or mixtures thereof.

The driveline lubricating composition may also comprise a foam inhibitor, pour point depressant, corrosion inhibitor, demulsifier, metal deactivator or additional seal swell agent or mixtures thereof. Suitable candidates are described above under "other additives". Corrosion inhibitors useful for a driveline device include 1-amino-2-propanol, amines, triazole derivatives including tolyl triazole, dimercaptothiadiazole derivatives, octylamine octanoate, condensation products of dodecenyl succinic acid or anhydride and/or a fatty acid such as oleic acid with a polyamine.

A driveline device lubricating composition in different embodiments may have a composition as disclosed in the following table:

TABLE 3

| | Embodiments (wt %) | | | |
|---|---|---|---|---|
| Additive | A | B | C | D |
| Compound of formula (I) | 0.01 or 0.5 to 5, or 0.05 to 1.5 | 0.01 to 15 | 0.5 to 3, 0.1 to 1, or 0.05 to 1.5 | 0.01 to 3, 0.2 to 0.5, or 0.05 to 1.5 |

TABLE 3-continued

| Additive | Embodiments (wt %) A | B | C | D |
|---|---|---|---|---|
| Dispersant | 1 to 4 | 0.1 to 10, 2 to 7 | 0 to 5 | 1 to 6 |
| Extreme Pressure Agent | 3 to 6 | 0 to 6 | 0 to 3 | 0 to 6 |
| Overbased Detergent | 0 to 1 | 0.01 to 3, 0.025 to 2 | 0.5 to 6 | 0.01 to 2 |
| Antioxidant | 0 to 5 | 0.01 to 10 or 2 | 0 to 3 | 0 to 2 |
| Additional Friction Modifier | 0 to 5 | 0.01 to 5 | 0.1 to 1.5 | 0 to 5 |
| Viscosity Modifier | 0.1 to 70 | 0.1 to 15 | 1 to 60 | 0.1 to 70 |
| Any Other Performance Additive | 0 to 10 | 0 to 8 or 10 | 0 to 6 | 0 to 10 |
| Oil of Lubricating Viscosity | Balance to 100% | Balance to 100% | Balance to 100% | Balance to 100% |

Footnote:

The viscosity modifier in the table above may also be considered as an alternative to an oil of lubricating viscosity.

Column A may be representative of an automotive or axle gear lubricant.

Column B may be representative of an automatic transmission lubricant.

Column C may be representative of an off-highway lubricant.

Column D may be representative of a manual transmission lubricant.

In one embodiment, the lubricating composition is an automatic transmission lubricant comprising: a compound of formula (I), dispersant in an amount of 0.1 to 10 wt %, a detergent in an amount of 0.025 to 3 wt % or when the detergent contains calcium, a detergent in an amount to contribute 130 to 600 ppm to the composition, a phosphorus containing compound in an amount of 0.01 to 0.3 wt %, an antiwear agent in an amount of 0.01 to 15 wt %, a viscosity modifier in an amount of 0 to 12 wt %, an antioxidant in an amount of 0 to 10 wt %, a corrosion inhibitor in an amount of 0.001 to 10 wt % and a friction modifier in an amount of 0.01 to 5 wt %. In one embodiment, the lubricating composition is an automatic transmission lubricant comprising: a compound of formula (I), a dispersant in an amount of 0.2 to 7 wt %, a detergent in an amount of 0.1 to 1 wt % or when the detergent contains calcium, a detergent in an amount to contribute 160 to 400 ppm to the composition, a phosphorus containing compound in an amount of 0.03 to 0.2 wt %, an antiwear agent in an amount of 0.05 to 10 wt %, a viscosity modifier in an amount of 0.1 to 10 wt %, an anti-oxidant in an amount of 0.01 to 5 wt %, a corrosion inhibitor in an amount of 0.005 to 5 wt % and a friction modifier in an amount of 0.01 to 4 wt %. In one embodiment, the lubricating composition is an automatic transmission lubricant comprising: a compound of formula (I), a dispersant in an amount of 0.3 to 6 wt %, a detergent in an amount of 0.1 to 8 wt % or when the detergent contains calcium, a detergent in an amount to contribute 0 to 250 ppm to the composition, a phosphorus containing compound in an amount of 0.03 to 0.1 wt %, an antiwear agent in an amount of 0.075 to 5 wt %, a viscosity modifier in an amount of 1 to 8 wt %, an antioxidant in an amount of 0.05 to 3 wt %, a corrosion inhibitor in an amount of 0.01 to 3 wt % and a friction modifier in an amount of 0.25 to 3.5 wt %. In one embodiment, the lubricating composition is an automatic transmission lubricant comprising: a compound of formula (I), a dispersant in an amount of 1 to 5 wt %, a detergent containing calcium in an amount to contribute 1 to 200 ppm to the composition, an antiwear agent in an amount of 0.1 to 3 wt %, a viscosity modifier in an amount of 3 to 8 wt %, an antioxidant in an amount of 0.1 to 1.2 wt %, a corrosion inhibitor in an amount of 0.02 to 2 wt % and a friction modifier in an amount of 0.1 to 3 wt %. In one embodiment, the lubricating composition is an automatic transmission lubricant comprising: a compound of formula (I), a detergent containing calcium in an amount to contribute 10 to 150 ppm to the composition, an antioxidant in an amount of 0.2 to 1 wt % and a friction modifier in an amount of 0.5 to 2.5 wt %. In one embodiment, the lubricating composition is an automatic transmission lubricant comprising: a compound of formula (I), a detergent containing calcium in an amount to contribute 20 to 100 ppm to the composition, an antioxidant in an amount of 0.3 to 1 wt % and a friction modifier in an amount of 1 to 2.5 wt %.

The invention also provides for a method of preparing the lubricating compositions disclosed herein. The method comprises mixing a compound of formula (I) with an oil of lubricating viscosity. Further additives as disclosed above can be mixed in as well. This method is effectively a method of improving the wear-reducing properties and/or the friction-reducing properties of the oil of lubricating viscosity. The presence of the compound of formula (I) imparts wear-reducing properties and/or friction-reducing properties to the oil of lubricating viscosity.

The invention also provides for a method of lubricating a mechanical device, which method comprises supplying to said device the composition of the invention either as the lubricating composition or as an additive concentrate to the lubricating composition. The method can involve an additional step of operating the mechanical device. The device can be a driveline device such as a gear, wherein the lubricating composition is a gear oil. The device can be an internal combustion engine, wherein the lubricating composition is an engine oil.

The invention also provides for the use of a compound according to formula (I) as an anti-wear agent and/or a friction-reducing agent in a lubricating composition.

The amount of each chemical component described herein is presented exclusive of any solvent or diluent oil, which may be customarily present in the commercial material, that is, on an active chemical basis, unless otherwise indicated. However, unless otherwise indicated, each chemical or composition referred to herein should be interpreted as being a commercial grade material which may contain the isomers, by-products, derivatives, and other such materials which are normally understood to be present in the commercial grade.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include:

hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form a ring);

substituted hydrocarbon substituents, that is, substituents containing non-hydrocarbon groups which, in the context of this invention, do not alter the predominantly hydrocarbon nature of the substituent (e.g., halo (especially chloro and fluoro), hydroxy, alkoxy, mercapto, alkylmercapto, nitro, nitroso, and sulfoxy);

hetero substituents, that is, substituents which, while having a predominantly hydrocarbon character, in the context of this invention, contain other than carbon in a ring or chain otherwise composed of carbon atoms and encompass substituents as pyridyl, furyl, thienyl and imidazolyl. Heteroatoms include sulfur, oxygen, and nitrogen. In general, no more than two, or no more than one, non-hydrocarbon substituent will be present for every ten carbon atoms in the hydrocarbyl group; alternatively, there may be no non-hydrocarbon substituents in the hydrocarbyl group.

It is known that some of the materials described above may interact in the final formulation, so that the components of the final formulation may be different from those that are initially added. For instance, metal ions (of, e.g., a detergent) can migrate to other acidic or anionic sites of other molecules. The products formed thereby, including the products formed upon employing the composition of the present invention in its intended use, may not be susceptible of easy description. Nevertheless, all such modifications and reaction products are included within the scope of the present invention; the present invention encompasses the composition prepared by admixing the components described above.

The following examples provide illustrations of the disclosed technology. These examples are non-exhaustive and are not intended to limit the scope of the disclosed technology.

Preparation of Borate Esters

The borate esters shown in Table 4 are synthesised via reaction between boric acid and the appropriate diol with the azeotropic removal of water.

The synthetic route, first reported by Nöth et al. (A. Lang, Knizek, H. Nöth, S. Schur, M. Thoman, Z. Anorg. Allg. Chem. 1997, 623, 901) for catechol, $C_6H_4$-1,2-$(OH)_2$, can be used, substituting catechol with the relevant hydrocarbyl-substituted catechol or diol. Specifically borate esters 1 and 2 are synthesised in good yields by the reaction between the diol and boric acid in refluxing toluene over a period of 72 hours.

Preparation of Borate Ester 1

To a solution of PIB-substituted catechol (10.8 g, 10.8 mmol) in toluene (150 $cm^3$), flushed with argon is added boric acid (0.67 g, 10.7 mmol) and the resulting mixture is refluxed with azeotropic removal of water for 72 hours. Optionally the mixture is filtered. Removal of volatiles in vacuo yields the borated ester as a viscous black oil. Yield=ca. 10 g.

Preparation of Borate Ester 2

To a solution of glycerol-1-monooleate (5.8 g, 16.2 mmol) in toluene (75 $cm^3$), flushed with argon is added boric acid (1.0 g, 16.1 mmol) and the resulting mixture is refluxed with azeotropic removal of water for 72 hours. Removal of volatiles in vacuo yields the borated ester 3 as a viscous orange oil. 11B NMR reveals a mixture of boric acid and borate ester product, therefore the compound is extracted into toluene to purify. Yield=5.8 g.

Preparation of Anti-Wear Compounds

Compounds containing dihydrogen phosphate complexes of the borate esters of Preparative Examples 1 and 2 are formed by stirring an equimolar mixture of either borate ester 1 or 2 with either $[N(butyl)_4][H_2PO_4]$ or $[(2\text{-ethylhexyl})_2NH_2][H_2PO_4]$ in dichloromethane solution at room temperature over a period of 24 hours. $[N(butyl)_4][H_2PO_4]$ is commercially available and $[(2\text{-ethylhexyl})_2NH_2][H_2PO_4]$ is synthesised according to equation 1.

Equation 1

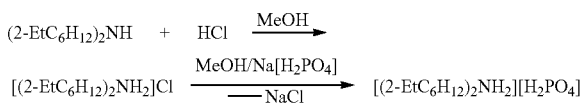

Preparation of Compound A of Table 1

A mixture of borate ester 1 (3.0 g, 1.5 mmol) and $[(2\text{-ethylhexyl})_2NH_2][H_2PO_4]$ (0.45 g, 1.2 mmol) in dry dichloromethane (30 $cm^3$) is stirred at room temperature for

TABLE 4

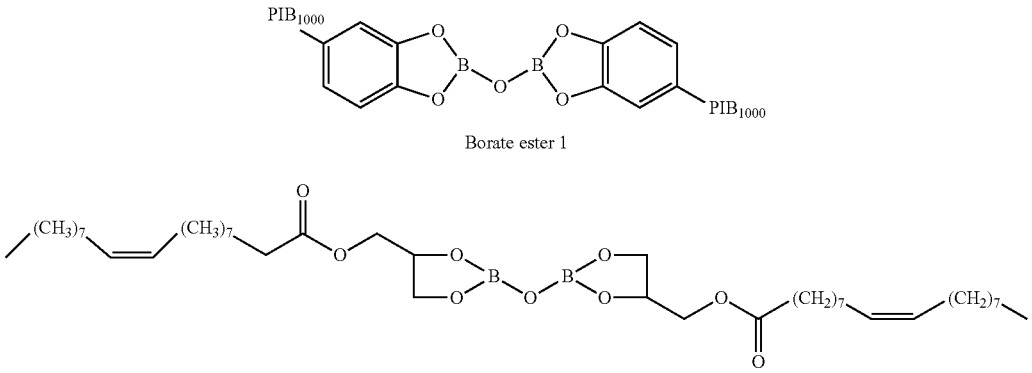

Borate ester 1

Borate ester 2

24 hours. Volatiles are removed in vacuo yielding compound A as a black, viscous oil. Yield=3.4 g.

Preparation of Compound B of Table 1

A mixture of borate ester 2 (3.0 g, 4 mmol) and $[(2\text{-ethylhexyl})_2NH_2][H_2PO_4]$ (1.2 g, 4 mmol) in dry dichloromethane (40 $cm^3$) is stirred at room temperature for 24 hours. Volatiles are removed in vacuo yielding compound C as an orange, viscous oil. Yield=4.1 g.

Preparation of Compound C of Table 1

Compound C is prepared in a manner similar to that of compounds A and B using a borate ester prepared from PIB 1000-substituted catechol and a tri-butyl amine mono-butyl phosphate ($[(butyl)_3NH][(butyl)HPO_4]$).

Experiment 1

The compound according to the invention is tested for wear and friction performance. Specifically, two lubricating compositions are prepared according to the formulations set out in the table below.

TABLE 5

| Component | Example 1 400 ppm P | Comparative Example 1 400 ppm P |
|---|---|---|
| Compound C | 3.38 | 0 |
| ZDDP (secondary alkyl) | 0 | 0.4 |
| Base oil | 96.62 (a mixture of base oils in the following ratio of 100 cSt PAO:6 cSt Group III:4 cSt Group III = 21.2564:37.6818:37.6818) | 99.6 (a mixture of base oils in the following ratio of 100 cSt PAO:6 cSt Group III:4 cSt Group III = 21.912:38.844:38.844) |

The compositions are such that either ZDDP or the compound of the invention is present in an amount to contribute 400 ppm of phosphorus to the composition.

The compositions are evaluated for wear and friction performance in a temperature controlled high frequency reciprocating rig (HFRR). HFFR conditions for the evaluations are 200 g and 500 g load, 75 minute duration, 1000 μm stroke, 20 Hz frequency and a temperature of 15 minutes at 40° C., then ramped to 160° C. at 2° C./min. The upper test piece is a 6 mm diameter steel ball (ANSI E-52100, Rockwell 'C' hardness 58-66 and a surface finish of Ra<0.05 μm), the lower test specimen being either a flat steel disc (ANSI E-52100, Vickers "HV30" hardness 190-210 and a surface finish of Ra<0.02 μm). Both the upper and lower specimens are available together from PCS Instruments (Part Number HFRSSP). The average wear scar, coefficient of friction and contact potential are measured. The contact potential is measured by applying a small electrical potential between the upper and lower test specimens. If the instrument measures the full electrical potential applied, this is indicative of an electrically insulating layer between the upper and lower test specimens, this is usually interpreted as the formation of a chemical protective film on the surfaces. If no protective film is formed there is metal to metal contact between the upper and lower test specimens and the measured electrical potential drops to zero. Intermediate values are indicative of partial or incomplete protective films. The contact potential is often presented as a percentage of the applied electrical potential and called percent film thickness. The results are shown in the table below.

TABLE 6

| Load | Sample | Average Wear Scar diameter (μm) | Average Coefficient of Friction | Average Contact Potential (%) |
|---|---|---|---|---|
| 200 g | Example 1 | 199 | 0.151 | 88 |
| 200 g | Comparative Example 1 | 213 | 0.189 | 70 |
| 500 g | Example 1 | 181 | 0.136 | 95 |
| 500 g | Comparative Example 1 | 238 | 0.171 | 67 |

The composition containing the compound of the invention showed a smaller wear scar, reduced coefficient of friction and increased contact potential under both loads, when compared to the composition containing the zinc dialkyldithiophosphate (ZDDP).

Experiment 2

The compounds according to the invention are tested for wear and friction performance in comparison to a known anti-wear agent. Three lubricating compositions are prepared according to the formulations set out in the table below:

TABLE 7

| Component | Example 2 308 ppm P | Example 3 308 ppm P | Comparative Example 2 539 ppm P |
|---|---|---|---|
| Extreme pressure agent (olefin sulphide) | 2 | 2 | 2 |
| (antifoam agent - 20 ppm) | 0.0598 | 0.0598 | 0.0598 |
| Friction modifier (alkenyl amide) | 0.1 | 0.1 | 0.1 |
| 600 N Group I base oil | 78.5549 | 79.05 | 79.9 |
| Group I 150 BS base oil | 13.8626 | 13.95 | 14.1 |
| Pour point depressant | 0.2 | 0.2 | 0.2 |
| compound A | 2.573 | | |
| compound B | | 1.077 | |
| Corrosion inhibitor (alkenyl amine) | 0.3497 | 0.3497 | 0.3497 |
| Anti-wear agent (amine salt of phosphoric acid esters) | | | 0.7 |
| Diluent oil | 0.5 | 1.4135 | 0.7905 |

The lubricating compositions represent typical gear oils. The formulations of Examples 2 and 3 are formulated so that the compounds of the invention contribute 308 ppm phosphorus to the formulation. The formulation of Comparative Example 2 is essentially the same as that of Examples 2 and 3 except that instead of containing a boron-phosphorus complex according to the invention, it contains an ammonium dialkyl phosphate antiwear agent which has the following structure:

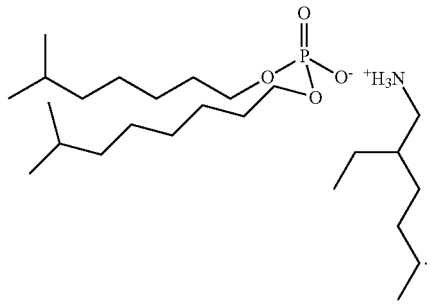

The ammonium dialkyl phosphate contributes 539 ppm phosphorus to the formulation of Comparative Example 2.

The gear oil compositions are evaluated for wear performance in a temperature controlled high frequency reciprocating rig (HFRR). HFRR conditions for the evaluations are 100 g load, 60 minute duration, 1000 μm stroke, 20 Hz frequency and an isothermal temperature of 100° C. The upper test piece is a 6 mm diameter steel ball (ANSI E-52100, Rockwell 'C' hardness 58-66 and a surface finish of Ra<0.05 μm), the lower test specimen being either a flat steel disc (ANSI E-52100, Vickers "HV30" hardness 190-210 and a surface finish of Ra<0.02 μm). Both the upper and lower specimens are available together from PCS Instruments (Part Number HFRSSP). The average wear scar, coefficient of friction and contact potential are measured. The contact potential is measured by applying a small electrical potential between the upper and lower test specimens. If the instrument measures the full electrical potential applied, this is indicative of an electrically insulating layer between the upper and lower test specimens, this is usually interpreted as the formation of a chemical protective film on the surfaces. If no protective film is formed there is metal to metal contact between the upper and lower test specimens and the measured electrical potential drops to zero. Intermediate values are indicative of partial or incomplete protective films. The contact potential is often presented as a percentage of the applied electrical potential and called percent film thickness. The results are shown in the table below.

TABLE 8

| Sample | Average Wear Scar diameter (μm) | Average Coefficient of Friction | Average Contact Potential (%) |
|---|---|---|---|
| Example 2 | 108 | 0.105 | 85 |
| | 113 | 0.095 | 85 |
| Example 3 | 137 | 0.110 | 76 |
| Comparative | 181 | 0.129 | 61 |
| Example 2 | 160 | 0.123 | 76 |

For each of Example 2 and Comparative Example 2, a repeat run is carried out and so two sets of results are shown. The results show that compositions of the invention yield smaller wear scars and lower coefficients of friction thus outperforming the comparative example, despite having a lower phosphorus content.

Experiment 3

In this experiment, a boron-phosphorus complex according to the invention is tested for wear and friction performance in comparison to a commercially available zinc dialkyldithiophosphate (ZDDP) anti-wear agent.

Two additive packages suitable for engine oils are prepared according to the formulations set out in the table below:

TABLE 9

| Component | Additive Package for Example 4 | Additive Package for Comparative Example 3 |
|---|---|---|
| Succinimide dispersant (30% oil) | 7 | 7 |
| Calcium phenate detergent (39% oil) | 0.1 | 0.1 |
| Calcium phenate detergent (27% oil) | 1.9 | 1.9 |
| Calcium sulfonate detergent (42% oil) | 0.1 | 0.1 |
| Zinc alkyldithiophosphate (9% oil) | | 0.25 |
| Zinc alkyldithiophosphate (8% oil) | | 0.25 |

TABLE 9-continued

| Component | Additive Package for Example 4 | Additive Package for Comparative Example 3 |
|---|---|---|
| Compound B | 1.694 | |
| Phenolic antioxidant (0% oil) | 1 | 1 |
| Aminic antioxidant (0% oil) | 1 | 1 |
| Polyolefin anhydride (0% oil) | 0.2 | 0.2 |
| Corrosion inhibitor (0% oil) | 0.1 | 0.1 |
| Friction modifier (alkenyl amide) (0% oil) | 0.05 | 0.05 |
| Triazole metal deactivator (0% oil) | 0.05 | 0.05 |
| Titanium salt (0% oil) | 0.024 | 0.024 |
| Diluent oil | 0.276 | 0.276 |
| TOTAL | 13.494 | 12.3 |

These packages are then blended into two formulations according to the details set out in Table 10.

TABLE 10

| Component | Example 4 500 ppm P | Comparative Example 3 500 ppm P |
|---|---|---|
| Base oil | 73.306 | 74.5 |
| Additive Package for Example 4 | 13.494 | |
| Additive Package for Comparative Example 3 | | 12.3 |
| Viscosity Modifier | 13 | 13 |
| Pour point depressant | 0.2 | 0.2 |

The resultant lubricating compositions represent engine oils. The formulation of Comparative Example 2 is the same as that as Example 4 except that instead of a compound according to the invention, it contains zinc alkyldithiophosphates. The compositions are formulated to equal phosphorus content.

The engine oil compositions are evaluated for wear and friction performance in a temperature controlled high frequency reciprocating rig (HFRR). HFFR conditions for the evaluations are 200 g and 500 g load, 75 minute duration, 1000 μm stroke, 20 Hz frequency and a temperature of 15 minutes at 40° C., then ramped to 160° C. at 2° C./min. The upper test piece is a 6 mm diameter steel ball (ANSI E-52100, Rockwell 'C' hardness 58-66 and a surface finish of Ra<0.05 μm), the lower test specimen being either a flat steel disc (ANSI E-52100, Vickers "HV30" hardness 190-210 and a surface finish of Ra<0.02 μm). Both the upper and lower specimens are available together from PCS Instruments (Part Number HFRSSP). The average wear scar, coefficient of friction and contact potential are measured. The contact potential is measured by applying a small electrical potential between the upper and lower test specimens. If the instrument measures the full electrical potential applied, this is indicative of an electrically insulating layer between the upper and lower test specimens, this is usually interpreted as the formation of a chemical protective film on the surfaces. If no protective film is formed there is metal to metal contact between the upper and lower test specimens and the measured electrical potential drops to zero. Intermediate values are indicative of partial or incomplete protective films. The contact potential is often presented as a percentage of the applied electrical potential and called percent film thickness. The results are shown in the table below.

TABLE 11

| Load | Sample | Average Wear Scar diameter (μm) | Average Coefficient of Friction | Average Contact Potential (%) |
|---|---|---|---|---|
| 200 g | Example 4 | 79 | 0.116 | 93 |
| 200 g | Comparative Example 3 | 137 | 0.171 | 79 |
| 500 g | Example 4 | 138 | 0.109 | 89 |
| 500 g | Comparative Example 3 | 195 | 0.166 | 13 |

The results show that when the boron-phosphorus complexes are used in the engine oil instead of zinc alkyldithiophosphate, the engine oil exhibits a reduction in wear and in coefficient of friction at both the 200 g and 500 g loads.

Each of the documents referred to above is incorporated herein by reference, including any prior applications, whether or not specifically listed above, from which priority is claimed. The mention of any document is not an admission that such document qualifies as prior art or constitutes the general knowledge of the skilled person in any jurisdiction. Except in the Examples, or where otherwise explicitly indicated, all numerical quantities in this description specifying amounts of materials, reaction conditions, molecular weights, number of carbon atoms, and the like, are to be understood as modified by the word "about." It is to be understood that the upper and lower amount, range, and ratio limits set forth herein may be independently combined. Similarly, the ranges and amounts for each element of the invention can be used together with ranges or amounts for any of the other elements. As used herein, the term "comprising" is intended also to encompass as alternative embodiments "consisting essentially of" and "consisting of." "Consisting essentially of" permits the inclusion of substances that do not materially affect the basic and novel characteristics of the composition under consideration.

What is claimed is:

1. A composition comprising an oil of lubricating viscosity and a compound of formula (I):

(I)

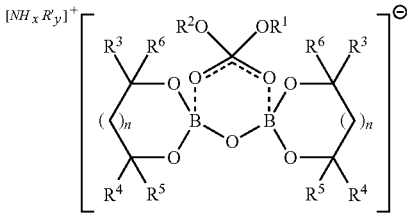

wherein x+y=4, x is an integer from 1 to 4, y is 0 or an integer from 1 to 3, and each $R^1$ is independently a hydrocarbyl group having from about 4 to about 22 carbon atoms;

$R^1$ and $R^2$ are each independently hydrogen or a hydrocarbyl group containing from about 4 to about 22 carbon atoms, and on each ring substituted with $R^3$ to $R^6$ independently, (i) n is 0 or 1, one of $R^3$ and $R^4$ is $CH_2$—O—C(O)—$R^7$ where $R^7$ is a hydrocarbyl group containing from about 8 to about 30 carbon atoms, and the other of $R^3$ and $R^4$, and each of $R^5$ and $R^6$ is chosen from hydrogen or a methyl group; or (ii) n is 0 or 1, one of $R^3$ and $R^4$ is a hydrocarbyl group containing from about 4 to about 22 carbon atoms and the other of $R^3$ and $R^4$ is independently a hydrocarbyl group containing from about 4 to about 22 carbon atoms or hydrogen, and each of $R^5$ and $R^6$ is hydrogen; or (iii) n is 0, $R^3$ and $R^4$ are linked, together with the carbons to which they are attached, to form a benzene ring which is substituted with a hydrocarbyl group $R^7$ containing from about 12 to about 100 carbon atoms, and $R^5$ and $R^6$ are not present.

2. The composition of claim 1, wherein at least one of $R^1$ and $R^2$ is a hydrocarbyl group containing from about 4 to about 22 carbon atoms.

3. The composition of claim 1, wherein on each ring substituted with $R^3$ to $R^6$ independently, n is 0 or 1, and (i) one of $R^3$ and $R^4$ is $CH_2$—O—C(O)—$R^7$ where $R^7$ is a hydrocarbyl group containing from about 8 to about 30 carbon atoms, and the other of $R^3$ and $R^4$, and each of $R^5$ and $R^6$ is chosen from hydrogen or a methyl group; or (ii) one of $R^3$ and $R^4$ is a hydrocarbyl group containing from about 4 to about 22 carbon atoms and the other of $R^3$ and $R^4$ is independently a hydrocarbyl group containing from about 4 to about 22 carbon atoms or hydrogen, and each of $R^5$ and $R^6$ is hydrogen.

4. The composition of claim 1, wherein, on each ring substituted with $R^3$ to $R^6$ independently, n is 0 or 1, one of $R^3$ and $R^4$ is —$CH_2$—O—C(O)—$R^7$ where $R^7$ is a hydrocarbyl group containing from about 8 to about 30 carbon atoms, and the other of $R^3$ and $R^4$, and each of $R^5$ and $R^6$ is chosen from hydrogen or a methyl group.

5. The composition of claim 4, wherein the on each ring substituted with $R^3$ to $R^6$ independently, n is 0 or 1, and either $R^3$ is —$CH_2$—O—C(O)—$R^7$ where $R^7$ is a hydrocarbyl group containing from about 8 to about 30 carbon atoms, $R^6$ is a methyl group and $R^5$ is hydrogen, or $R^4$ is —$CH_2$—O—C(O)—$R^7$ where $R^7$ is a hydrocarbyl group containing from about 8 to about 30 carbon atoms, $R^5$ is a methyl group and $R^6$ is hydrogen.

6. The composition of claim 1, wherein, on each ring substituted with $R^3$ to $R^6$ independently, n is 0 or 1, one of $R^3$ and $R^4$ is a hydrocarbyl group containing from about 4 to about 22 carbon atoms and the other of $R^3$ and $R^4$ is independently hydrogen or a hydrocarbyl group containing from about 4 to about 22 carbon atoms, and each of $R^5$ and $R^6$ is hydrogen.

7. The composition of claim 6, wherein the sum of the carbon atoms in the $R^3$ and the $R^4$ groups on each ring substituted with $R^3$ to $R^6$ is 22 or less.

8. The composition of claim 5 wherein at least one of $R^1$ or $R^2$ is a hydrocarbyl group containing at least 8 carbon atoms.

9. The composition of claim 1, wherein n is 0.

10. The composition of claim 1, wherein n is 0, $R^3$ and $R^4$ are linked, together with the carbons to which they are attached, to form a benzene ring which is substituted with a hydrocarbyl group $R^7$ containing from about 12 to about 100 carbon atoms, and $R^5$ and $R^6$ are absent.

11. The composition of claim 1, wherein R' is a hydrocarbyl group containing 8 carbon atoms.

12. The composition according to claim 10, wherein x=y=2 and R' is a 2-ethylhexyl group.

13. The composition of claim 1, wherein the amount of the compound of formula (I) present in the composition is from about 0.5 to about 15 weight percent.

14. The composition of claim 1, wherein the compound of formula (I) is present in an amount so as to contribute 300 to 1200 ppm phosphorus to the composition.

15. A composition comprising an oil of lubricating viscosity and a compound obtainable by reacting boric acid with a diol to form an ester and reacting said ester with an ammonium salt of phosphoric acid or a hydrocarbyl-substituted phosphoric acid, wherein said diol:

(i) is a partial ester diol having the formula $R^3(OH)CR_6$—$(CH_2)_n$—$CR_5R^4(OH)$ where n is 0 or 1, one of $R^3$ and $R^4$ is —$CH_2$—O—C(O)—$R^7$, $R^7$ is a hydrocarbyl group containing from about 8 to about 30 carbon atoms, and the other of $R^3$ and $R^4$ and each of $R^5$ and $R^6$ is hydrogen or a methyl group, or (ii) is a hydrocarbyl-containing diol having the formula $R^3(OH)CR^6$—$(CH_2)_n$—$CR_5R^4(OH)$ where n is 0 or 1, one of $R^3$ and $R^4$ is a hydrocarbyl group containing from about 4 to about 22 carbon atoms and the other of $R^3$ and $R^4$ is independently a hydrocarbyl group containing from about 4 to about 22 carbon atoms or hydrogen, and each of $R^5$ and $R^6$ is hydrogen or a methyl group, or (iii) is an aromatic diol substituted with a hydrocarbyl group, wherein the hydrocarbyl group contains from about 12 to about 100 carbon atoms.

16. A composition according to claim 15, wherein said ammonium salt of a phosphoric acid or a hydrocarbyl-substituted phosphoric acid has the formula $[NR_xR'_y]^+[R^1R^2PO_4]^-$, where x+y=4, x is an integer from 1 to 4, y is 0 or an integer from 1 to 3 and each R' is independently a hydrocarbyl group having from about 4 to about 22 carbon atoms, and $R^1$ and $R^2$ are each independently hydrogen or a hydrocarbyl group containing from about 4 to about 22 carbon atoms.

17. A method of lubricating a mechanical device, wherein said method comprises supplying a composition according to claim 1 to said mechanical device.

18. The method of claim 17, wherein the said mechanical device is an internal combustion engine or a driveline device.

* * * * *